US007779599B2

(12) United States Patent
Jolicoeur et al.

(10) Patent No.: US 7,779,599 B2
(45) Date of Patent: Aug. 24, 2010

(54) ARTICULATING WORK PLATFORM SUPPORT SYSTEM, WORK PLATFORM SYSTEM, AND METHODS OF USE THEREOF

(75) Inventors: Paul Jolicoeur, Troy, NY (US); Roy Scrafford, Scotia, NY (US); Clifford Westrick, Albany, NY (US); Dave Gordon, Schenectady, NY (US); Tom Silic, Saratoga Springs, NY (US); Edward Tifft, N. Bennington, VT (US); Mathieu Grumberg, Delmar, NY (US)

(73) Assignee: Safway Services, LLC, Waukesha, WI (US)

( * ) Notice: Subject to any disclaimer, the term of this patent is extended or adjusted under 35 U.S.C. 154(b) by 334 days.

(21) Appl. No.: 10/814,945

(22) Filed: Mar. 31, 2004

(65) Prior Publication Data

US 2005/0217936 A1 Oct. 6, 2005

(51) Int. Cl.
*E04H 12/00* (2006.01)

(52) U.S. Cl. ..... 52/650.3; 52/651.1; 52/637; 182/150

(58) Field of Classification Search ..... 52/634, 52/646, 656.9, 169.12, 647, 648.1, 650.3, 52/651.1, 633, 636, 641, 653.1, 654.1, 655.1, 52/693; 403/169, 170, 178, 217, 218; 182/141, 182/142, 150
See application file for complete search history.

(56) References Cited

U.S. PATENT DOCUMENTS

| | | | | |
|---|---|---|---|---|
| 748,962 | A * | 1/1904 | Lewis | 187/370 |
| 1,819,031 | A | 8/1931 | Kuhlman | |
| 2,303,428 | A | 12/1942 | Black | |
| 2,882,099 | A | 4/1959 | Symons | |
| 2,903,282 | A | 9/1959 | Wright | |
| 2,987,148 | A | 6/1961 | Millard | |
| 2,994,402 | A | 8/1961 | Tyler | |
| 3,420,011 | A * | 1/1969 | Takahashi | 52/83 |
| 3,425,179 | A | 2/1969 | Haroldson | |
| 3,635,509 | A * | 1/1972 | Birkemeier et al. | 403/173 |
| 4,244,152 | A * | 1/1981 | Harper, Jr. | 52/81.3 |
| 4,566,245 | A | 1/1986 | Ruter | |

(Continued)

FOREIGN PATENT DOCUMENTS

AU 200138987 B2 11/2001

(Continued)

OTHER PUBLICATIONS

ITOCHU Construction Machinery Co., Ltd., SK Panel Platform System brochure.

(Continued)

*Primary Examiner*—Richard E Chilcot, Jr.
*Assistant Examiner*—William V Gilbert
(74) *Attorney, Agent, or Firm*—Whyte Hirchboeck Dudek S.C.

(57) ABSTRACT

The invention includes a work platform and support system that includes a hub and joist configuration, wherein the hubs and joists are capable of articulation, or pivoting. One method of installation allows for sections of new work platform system to be extended from an existing suspended work platform system. The system is also capable of supporting, without failure, its own weight and at least four times the maximum intended load applied to it.

48 Claims, 30 Drawing Sheets

U.S. PATENT DOCUMENTS

| | | | | |
|---|---|---|---|---|
| 4,574,535 | A | 3/1986 | Pabsch | |
| 4,660,680 | A | 4/1987 | Potin | |
| 4,685,535 | A | 8/1987 | Bush et al. | |
| 4,815,563 | A | 3/1989 | Puccinelli et al. | |
| 5,203,428 | A | 4/1993 | Beeche | |
| 5,214,899 | A | 6/1993 | Beeche et al. | |
| 5,274,980 | A | 1/1994 | Zeigler | |
| D366,531 | S | 1/1996 | Wedge | |
| 5,771,655 | A * | 6/1998 | Strickland et al. | 52/745.2 |
| 6,223,482 | B1 | 5/2001 | Zohar | |
| 6,386,319 | B2 | 5/2002 | Apostolopoulos | |
| 2004/0020138 | A1 | 2/2004 | Grearson | |

FOREIGN PATENT DOCUMENTS

| | | | |
|---|---|---|---|
| EP | 0606807 | A1 | 7/1994 |
| FR | 2618818 | A1 | 2/1989 |
| GB | 2022647 | A | 12/1979 |
| JP | 11013276 | A | 1/1999 |
| JP | 2003097046 | A | 4/2003 |

OTHER PUBLICATIONS

Written Opinion of the International Searching Authority, mailed Nov. 22, 2006, for PCT App. No. PCT/US05/10165 filed on Mar. 28, 2005.

International Search Report, mailed Nov. 22, 2006, for PCT App. No. PCT/US05/10165 filed on Mar. 28, 2005.

Notification of First Office Action, mailed Jun. 28, 2008 for Chinese App. No. 200580017769.3.

Notification of Second Office Action, mailed Dec. 26, 2008 for Chinese App. No. 200580017769.3.

Notification of Third Office Action, mailed Jun. 26, 2009 for Chinese App. No. 200580017769.3.

First Office Action; Taiwan Intellectual Property Office (TIPO); Dec. 8, 2005; English translation, p. 2.

Second Office Action; Taiwan Intellectual Property Office (TIPO); Sep. 7, 2006; 3 pages.

Scaf-West—Scaffold Constructors & Designers; scafwest.com (5 pages); circa 2002.

Project: Houghton/Hancock Vertical Lift Bridge, Hancock, MI, circa 1984 (1 page).

International Application No. EP 05730794; Supplementary European Search Report; May 25, 2010; 2 pages.

* cited by examiner

ARTICULATING WORK PLATFORM SUPPORT SYSTEM, WORK PLATFORM SYSTEM, AND METHODS OF USE THEREOF

BACKGROUND OF THE INVENTION

1. Technical Field

The invention relates, generally, to the field of construction and temporary work platforms that are erected to access various parts of various structures. Specifically, the invention relates to a unique articulating work platform support system, a work platform system, the various pieces of such systems and methods of using and manufacturing the same.

2. Related Art

Current work platform structures suffer from numerous deficiencies and shortcomings. Paramount to all work platforms that are suspended above the ground is the safety of the workers using them. For all work platform systems, in order to be legal, must meet numerous regulations promulgated by the U.S. Department of Labor Occupational Safety and Health Administration (i.e., "OSHA"). Many work platform systems currently used in the marketplace are believed to not meet all of these OSHA regulations.

Additionally, in the construction industry, costs are always of significant importance. Whether the construction project is a public works project (e.g., low bid), or a private project, reducing and/or maintaining costs is critical to the contractor(s) and the owner. Reducing labor, material, and/or equipment costs all help to address the all important cost.

In the area of work platforms and support systems, a significant portion of the cost is for the labor to erect and disassemble.

Some current work platform systems, require full assembly remote from the final installation location (e.g., on the ground; in a construction "yard", etc.), and then transporting (e.g., jacking, winching, lifting, moving, etc.) the assembled work platform into its requisite final location on the job site. This "build-then-move" aspect of many work platform systems is time consuming and requires significant labor and equipment to complete.

In summary, a need exists to overcome the above stated, and other, deficiencies in the art of work platform and work platform support systems. A need exists for an improved system that clearly meets, and exceeds, all OSHA regulations, while also requiring reduced time, labor, and equipment, to assemble, move, extend, and disassemble.

SUMMARY OF THE INVENTION

To overcome the aforementioned, and other, deficiencies, the present invention provides a device for use with work platform system, a work platform support system, a work platform system, and a method of manufacturing and installing same.

In a first general aspect, the present invention provides an apparatus comprising:

a plurality of joists; and a plurality of hubs pivotally attached to said plurality of joists, wherein said plurality of hubs are adapted to receive a work platform.

In a second general aspect, the present invention provides a work platform support system comprising:

a plurality of joists;

a plurality of hubs, wherein each hub operatively connects to at least two joists; and further wherein said system is configured to be articulating.

In a third general aspect, the present invention provides a work platform system comprising:

a plurality of joists;

a plurality of hubs, wherein each hub pivotally connects to at least two joists; and at least one work platform which rests on at least one of said plurality of joists, said plurality of hubs, or a combination thereof.

In a fourth general aspect, the present invention provides a device for interconnecting with at least one joist of a work platform support system comprising:

a first surface with a first set of openings;

a second surface substantially parallel to said first surface, said second surface having a second set of openings; and a structural element interspersed between said first surface and said second surface, wherein at least one of said first set and said second set of openings is adapted to provide an articulation of said device when interconnected with said at least one joist.

In a fifth general aspect, the present invention provides a work platform system comprising:

at least one hub;

at least one joist interconnected with said at least one hub; and at least one section formed from said at least one hub and said at least one joist, wherein said at least one section can be articulated from a first position into a second position, further wherein said at least one section is capable of supporting without failure its own weight and at least about four times the maximum intended load applied or transmitted to it.

In a sixth general aspect, the present invention provides a work platform system for suspending a work platform from a structure, said system comprising:

a plurality of joists;

at least one hub for interconnecting at least two of said plurality of joists, wherein said at least two joists may articulate; and a suspension connector for suspending said system from said structure.

In a seventh general aspect, the present invention provides method comprising:

providing a plurality of joists; and pivotally attaching at least one hub to at least two of said plurality of joists, wherein said at least one hub is adapted to receive a work platform.

In a eighth general aspect, the present invention provides a method of installing a work platform support system to a structure comprising:

providing a plurality of joists;

providing at least one hub;

pivotally attaching at least one hub to said plurality of joists; and suspending said at least one hub from said structure.

In a ninth general aspect, the present invention provides method of extending a second work platform system from a first, suspended work platform system, said method comprising:

attaching a plurality of joists to said first system;

attaching a plurality of hubs to said plurality of joists;

articulating said plurality of joists and plurality of hubs, thereby forming said extending second work platform system.

The foregoing and other features and advantages of the invention will be apparent from the following more particular description of embodiments of the invention. It is to be understood that both the foregoing general description and the following detailed description are exemplary, but are not restrictive, of the invention.

BRIEF DESCRIPTION OF THE DRAWINGS

The features of the present invention will best be understood from a detailed description of the invention and an embodiment thereof selected for the purposes of illustration and shown in the accompanying drawings in which.

DETAILED DESCRIPTION OF THE INVENTION

Figure 1:
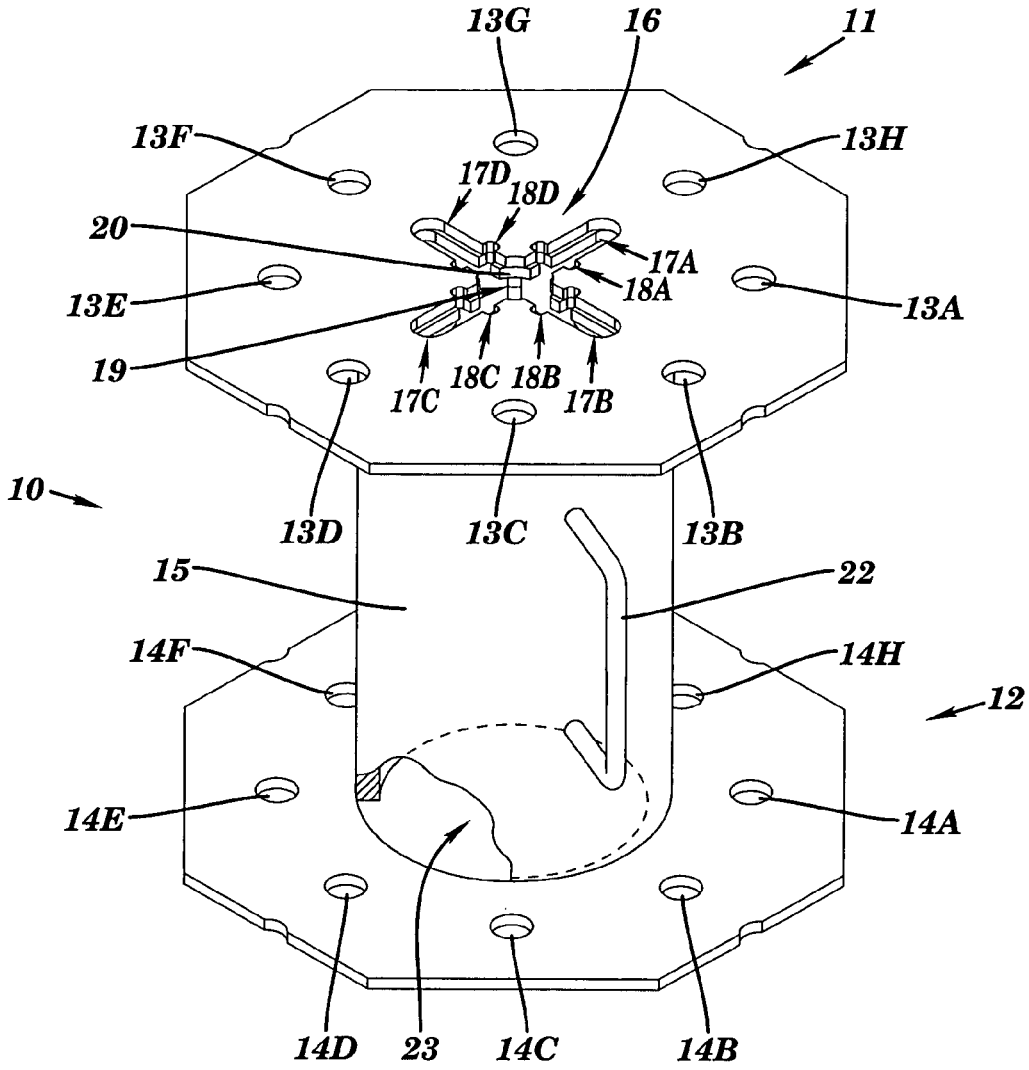
FIG. 1 is top perspective view of a hub, in accordance with the present invention.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring now to the drawings, FIG. 1 illustrates a portion of the present invention, namely a hub, herein denoted by a 10. The hub 10 which connects with a joist 30 (See e.g., FIG. 5), makes up in integral portion of a work platform support system and work platform system. A joist is any elongate structural member adapted for bearing or supporting a load, such as a bar joist, truss, shaped-steel (i.e., I-beam, C-beam, etc.), or the like. The hub 10 is configured so that, when attached to a joist 30, allows for articulation of both the hub 10 and the joist 30. A hub is an interconnection structure, such as a node, hinge, pivot, post, column, center, shaft, spindle, or the like. Articulation, as used herein, is defined as the capability to swing, and/or rotate, about a pivot point or axis. As will be discussed in more detail below, this articulation feature inter alia allows for less manpower to readily assemble and disassemble components of the system in, or near, the desired finished position.

The hub 10 includes a top element 11 and a bottom element 12 spaced at distal ends of a middle section 15. The top element 11 and bottom element 12 may be substantially planar in configuration, as well as, being parallel to each other. The top element 11 and bottom element 12, in the embodiment shown, are octagonal in plan. The middle section 15 may be a cylindrical section wherein a longitudinal axis of the middle section 15 is normal to the planes of the top element 11 and bottom element 12. In the embodiment shown, the middle section 15 is a right circular cylinder. In FIG. 1, a lower portion of the middle section 15 is removed for clarity purposes to show that the middle section 15 is hollow.

There are a plurality of openings 13, 14, extending through both the top element 11 and bottom element 12, respectively. The plurality of openings 13 (e.g., 13A, 13B, 13C, 13D, 13E, 13F, 13G, 13H) are interspersed on the top element 11 so as to offer various locations for connecting to one, or more, joists 30 (see e.g., FIG. 5). The plurality of openings 14 (e.g., 14A, 14B, 14C, 14D, 14E, 14F, 14G, 14H) are similarly spaced on the bottom element 12 so that respective openings (e.g., 13A and 14A) are coaxial.

At the center of the top element 11 is a center opening 16 which is configured to receive suspension connector (See e.g., FIGS. 22, 23A, 24A, 24B). The center opening 16 may be generally cruciform in configuration due to its center opening area 19 with four slots 17 (e.g., 17A, 17B, 17C, 17D) extending therefrom. Transverse to each of the four slots 17A, 17B, 17C, 17D, and interconnected thereto, are a series of cross slots 18A, 18B, 18C, 18D, whose utility will be apparent as discussed below. For added strength a second reinforcing plate 20 is added to the underside of the top element 11 wherein openings on the reinforcing plate 20 correspond to the center opening 16 configuration and all the ancillary openings thereto (17, 18, 19). A handle 22 is optionally added to the side of the middle section 15.

Figure 2:
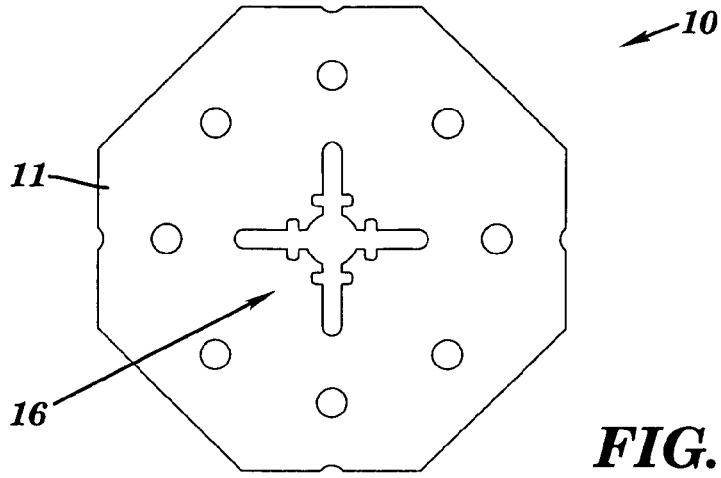
FIG. 2 is top view of a hub, in accordance with the present invention.
Figure 3:
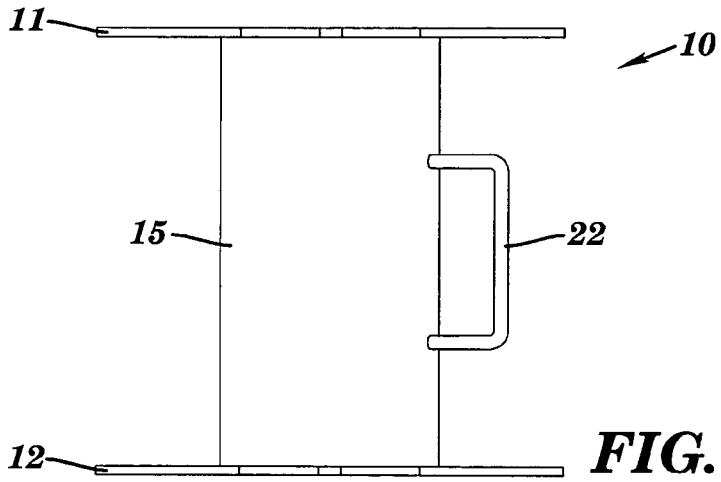
FIG. 3 is a side elevation view of an embodiment of a hub, in accordance with the present invention.
Figure 4:
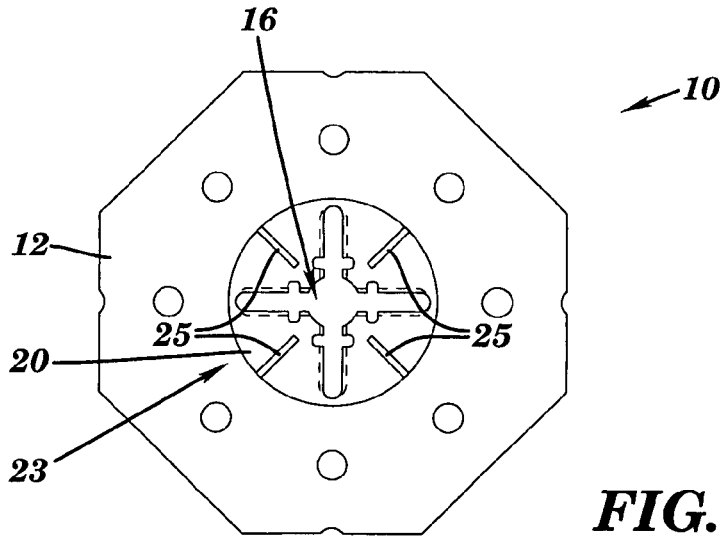
FIG. 4 is bottom view of a hub, in accordance with the present invention.

FIGS. 2, 3, and 4 show the top, side, and bottom view of the same embodiment of the hub 10 depicted in FIG. 1. FIG. 4 shows inter alia a bottom opening 23 on the bottom element 12. The bottom face of the reinforcing 20 can be seen within the bottom opening 23. Attached to the reinforcing 20 and the interior face of the middle section 15 are a plurality of gussets 25 that provide added support to the hub 10.

Figure 5:
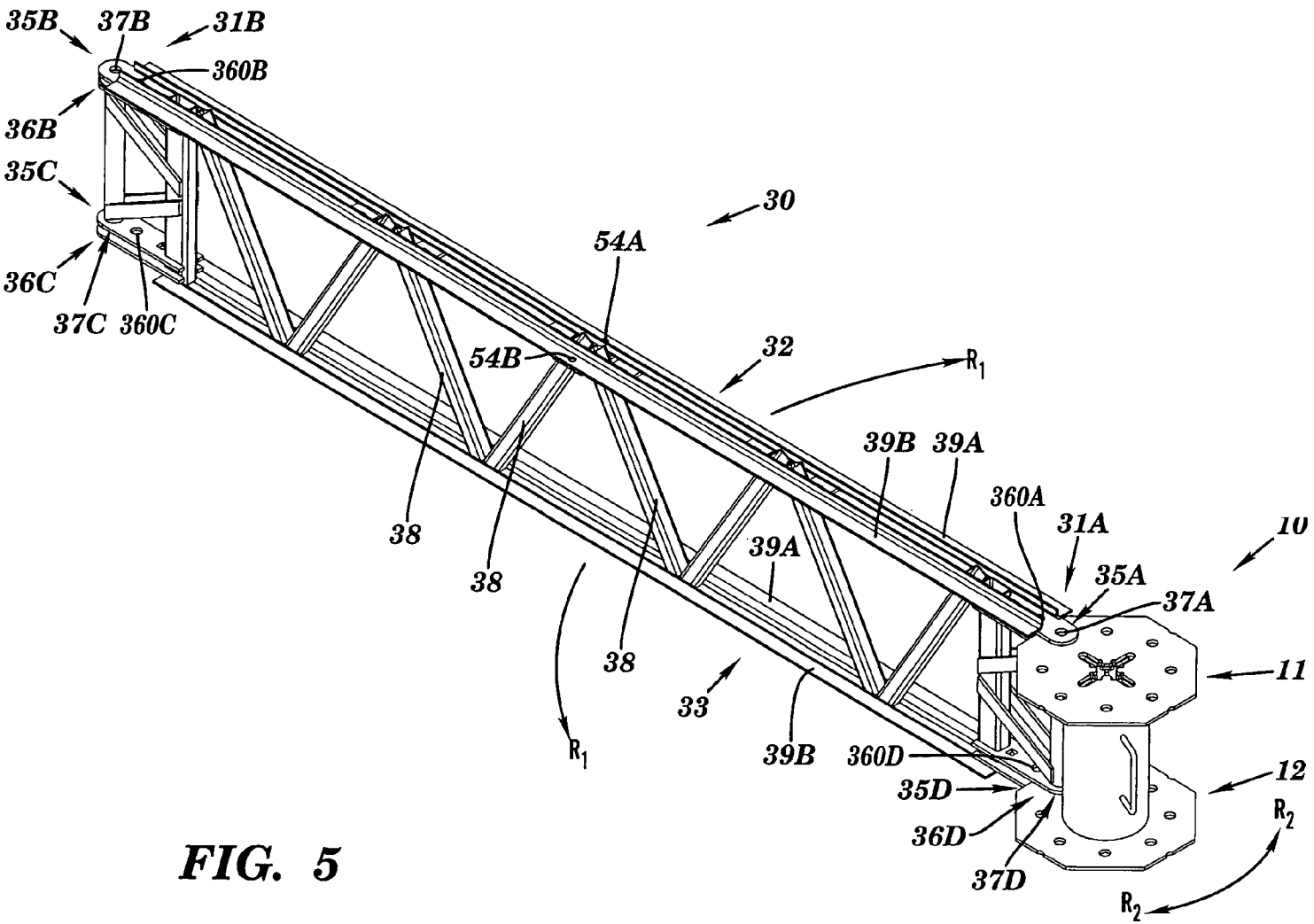
FIG. 5 is a top perspective view of a hub and joist, in accordance with the present invention.
Figure 6B:
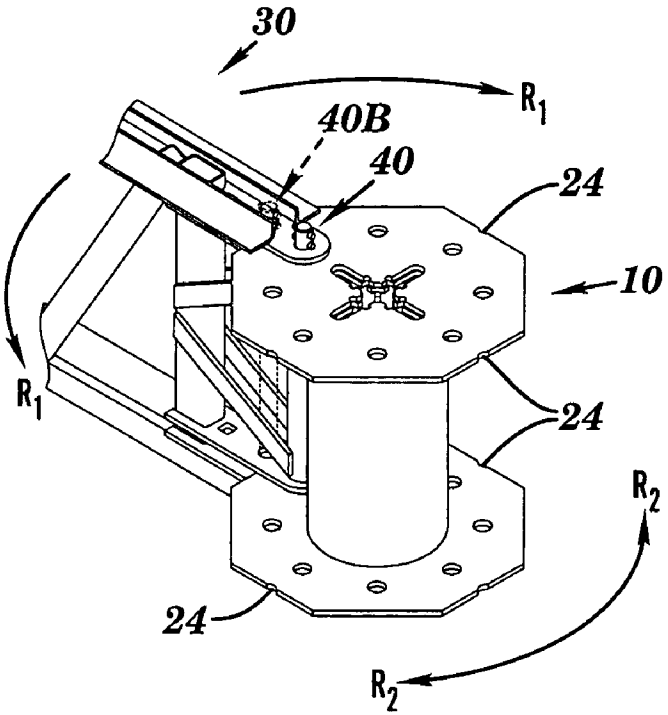
FIG. 6B is a top perspective view of the view in FIG. 6A, in accordance with the present invention.
Figure 6A:
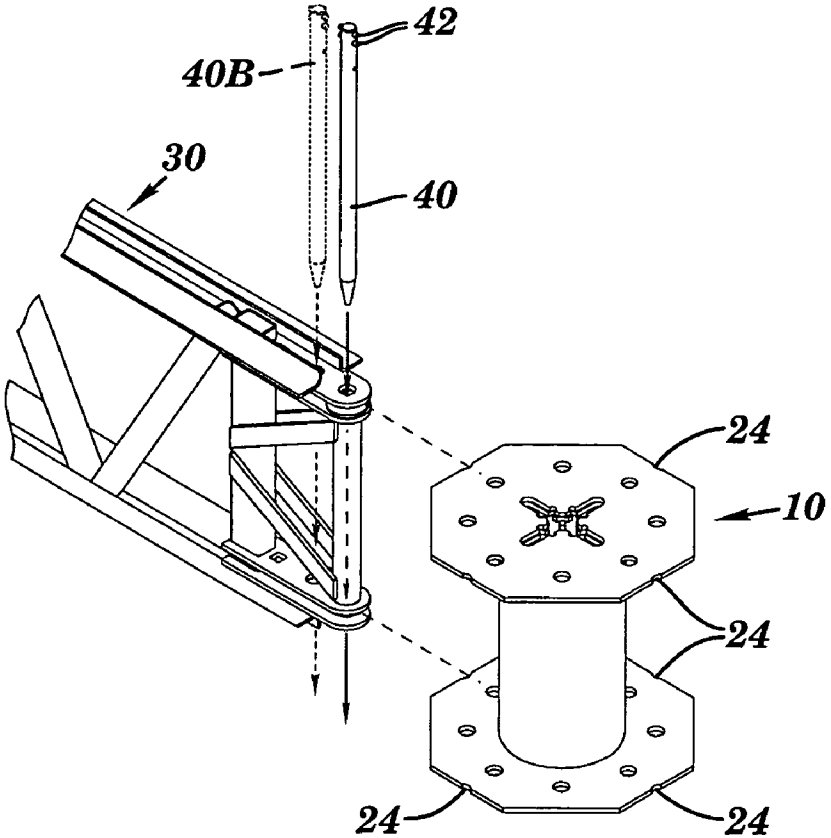
FIG. 6A is an exploded top perspective view of an interconnection between a hub and joist, in accordance with the present invention.

FIG. 5 depicts a top perspective view of the interconnection between a single hub 10 and a single joist 30, while FIGS. 6A and 6B shows a exploded close-up view, and a regular perspective close-up view, respectively, of a typical connection detail between the hub 10 and joist 30.

The joist 30 includes an upper element 32 and a bottom element 33. Interspersed between elements 32, 33 are a plurality of diagonal support members 38. Each element 32, 33 is made of two L-shaped pieces of angle iron 39A, 39B. Elements 32, 33 typically may be identical in construction, with the exception being upper element 32 includes connector holes 54A, 54B at its midspan (See e.g., FIGS. 8A, 8B). The joist 30 includes a first end 31A and a second end 31B. At either end 31A, 31B of both the upper element 32 and bottom element 33 extends an upper connecting flange 35 and a lower connecting flange 36. Through both upper and lower connection flanges 35, 36 are connecting holes 37. Thus, there are four upper connecting flanges 35A, 35B, 35C, 35D; four lower connecting flanges 36A, 36B, 36C, 36D. Thus, at a first end 31A, extending from the upper element 32, is an upper connection flange 35A and lower connection flange 36A, with a connecting hole 37A therethrough. Similarly, at the second end 31A of the upper element 32, extends an upper connection flange 35B and lower connection flange 36B, with a connecting hole 37B therethrough. Continuing, at the first end 31A of the lower element 33 extends an upper connection flange 35D and lower connection flange 36D. Through these connection flanges 35D, 36D are a connecting hole 37D. At the second end 31B of the joist 30 extending from the lower element 33 is an upper connection flange 35C and lower connection flange 36C with a connecting hole 37C therethrough.

Interior to each of the connector holes 37A, 37B, 37C, 37D are additional locking holes 360A, 360B, 360C, 360D also located on the connection flanges 35A, 35B, 35C, 35D.

As FIGS. 6A and 6B depict in further clarity, a pin 40 may be placed through the connecting holes 37 any two corresponding top and bottom openings 13, 14 of the hub 10. In this manner, the joist 30 can be connected in a virtually limitless number of ways, and angles, to the hub 10. For example, a pin 40 may be placed in through an upper connection flange 35A; through a opening 13A; through a lower connection flange 36A (all of the first end 31A of the upper element 32); through an upper connection flange 35D; through an opening 14A; and, then through the lower connection flange 36D. In this scenario, the pin 40 further threads through connecting holes 37A and 37D. The pin 40 includes two roll pins 42 at its upper end. The lower of the two roll pins 42 acts as a stop, thereby preventing the pin 40 from slipping all the way through the joist 30 and hub 10. The upper roll pin 42 acts as a finger hold to allow easy purchase and removal of the pin 40 from the joist 30 and hub 10. The design of these various parts are such that free rotation of both the joist 30 and hub 10 is allowed, even while the joist 30 and hub 10 are connected together. Rotational arrow $R_1$ show the rotation of the joist 30, while rotational arrow $R_2$ shows the rotation of the hub 10. These rotational capabilities of the joist 30 and hub 10 provide, in part, the articulating capability of the present invention.

A second optional locking pin 40B may be added through the locking holes 360A, 360C, 360C, 360D at the end of joist 30 in order to lock the joist 30 to prevent articulation, if so desired. The locking pin 40B abuts a groove 24 on the hub 10. The grooves are situated on both the upper element 11 and lower element 12. Similarly, the locking pin 40B can include additional two roll pins 42 as does the pin 40.

It should be apparent to one skilled in the art, that while the joist 30 depicted in the figures is made of particular shaped elements, there are other embodiments that provide the aspects of the present invention. For example, the joist 30 in the figures may commonly be called a bar joist, or open-web beam or joist, the joist 30 could also be made of structural tubing. That is the joist 30 could be made of multiple pieces of stuctural tubing shapes; or, the joist 30 could be one single structural tubing shape. Similarly, the joist 30 could be made of shaped steel (e.g., wide flange elements, narrow flange members, etc.), or other suitable shapes and materials.

Figure 7:
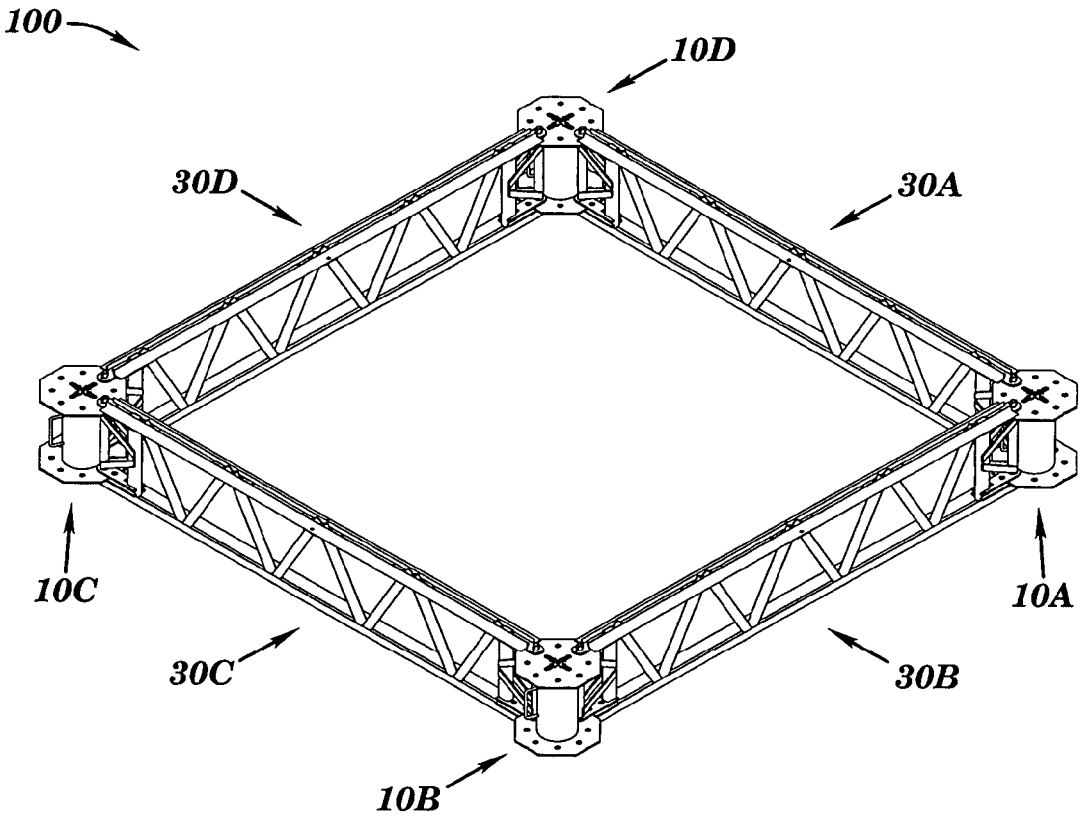
FIG. 7 is a top perspective view of a work platform support system, in accordance with the present invention.

FIG. 7 depicts a section, or module", of a work platform support system 100 as constructed. Note that four hubs 10A, 10B, 10C, 10D are interconnected with four joists 30A, 30B, 30C, 30D. FIG. 7 shows a work platform support system 100 that is square in plan. It should be apparent to one skilled in the art, that other shapes and configurations can be made. By varying the lengths of joists 30, for example, other shapes can be made. For example, a work platform support system 100 that is rectangular can be constructed. Also, by attaching joists 30 to various openings 13, 14 of the hub 10, various angles at which the joists 30 interconnect with the hubs 10 can be achieved. For example, a work platform support system 100 that is triangular in plan (not shown) may be constructed. Thus, by changing joist 30 lengths (See e.g., FIGS. 19A-19D) and/or changing the angle(s) at which the joists 30 extend from the hubs 10, virtually any shape and size work platform support system 100 may be constructed. Further, different shape, size, and configuration of work platform support system 100 can be joined and abutted with each other, so that the work platform design is virtually completely customizable. This adaptability of the work platform support system 100 provides a convenient way to gain access to virtually any shape work area required in construction.

Figure 8B:
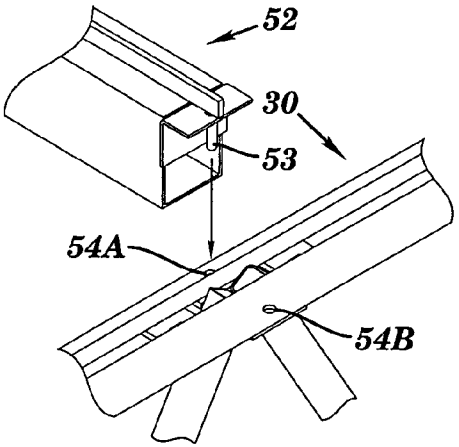
FIG. 8B is a exploded reverse top perspective view of an interconnection between a joist and deck support, in accordance with the present invention.
Figure 8C:
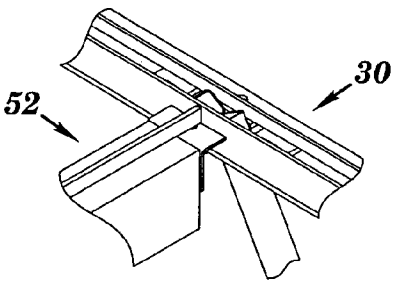
FIG. 8C is a close-up top perspective view of an interconnection between a joist and deck support, in accordance with the present invention.
Figure 8A:
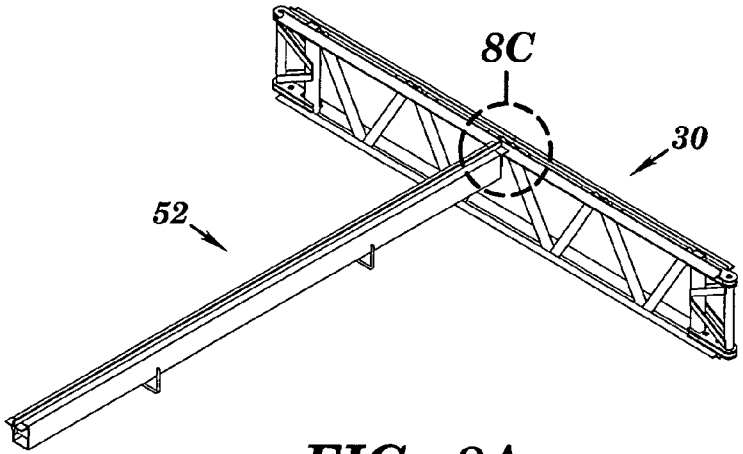
FIG. 8A is a top perspective view of an interconnection between a joist and deck support, in accordance with the present invention.

FIGS. 8A, 8B, and 8C depict various views, and close-up views of the interconnection between a middle support deck joist 52 and the joist 30. The middle support deck joist 52 provides added support to support platforms 50 (see e.g., FIG. 9) and may span between two joists 30. At either end of the middle support deck joist 52 is a pin 53 which communicates with a corresponding hole 54 on the upper portion of the joist 30. For example, FIG. 8B depicts an exploded view of the interconnection, wherein pin 53 will go in hole 54A. In this manner, movement (both lateral and axial) of the middle support deck joist 52 is minimized.

Figure 9:
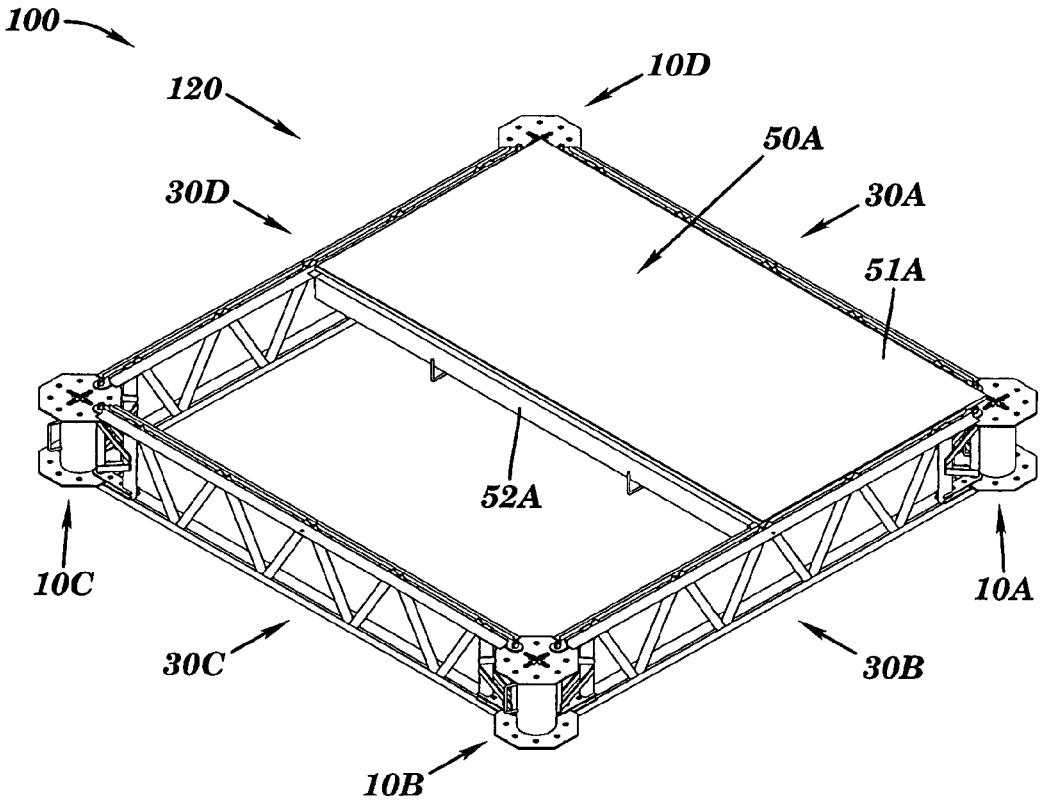
FIG. 9 is a top perspective view of a work platform support system and work platform system, in accordance with the present invention.
Figure 10:
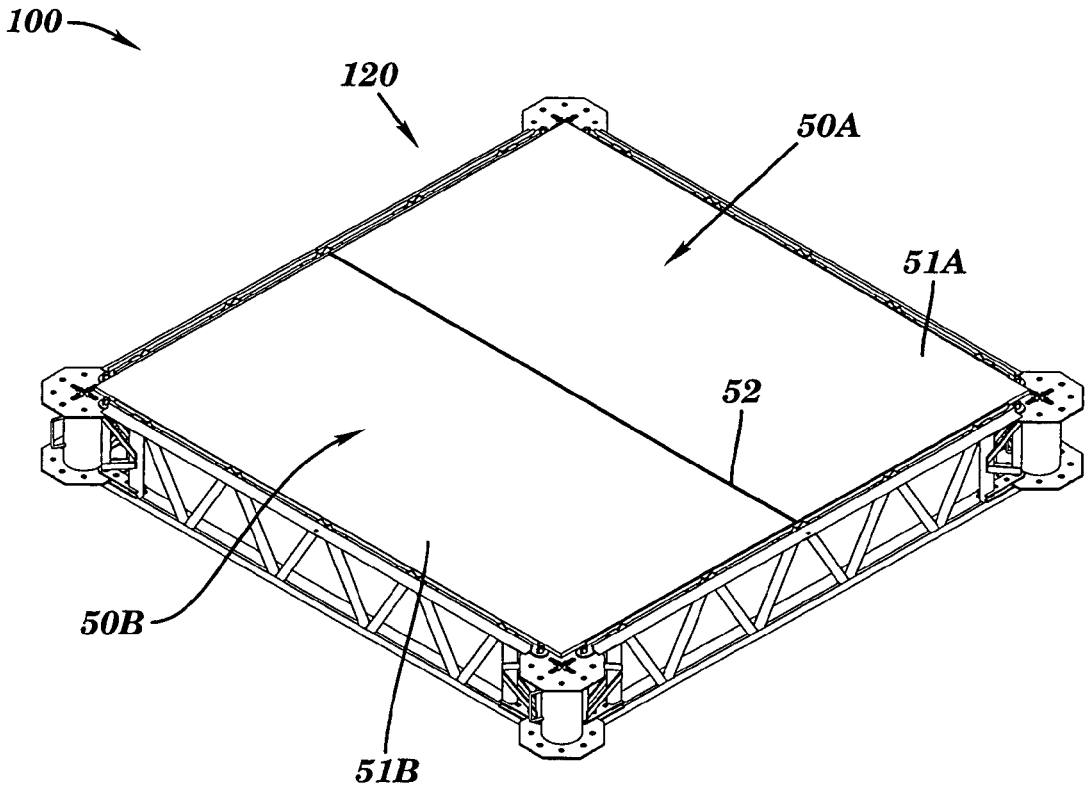
FIG. 10 is a top perspective view of a second embodiment of a work platform support system and work platform system, in accordance with the present invention.

FIG. 9 shows the embodiment of support system 100 from FIG. 7 wherein a platform 50A has been placed on the support system 100 thus transforming the support system 100 into a work platform system 120. The platform 50A rests, in this embodiment, on the middle support deck joist 52A and on the joists 30A, 30B, 30D. The edges of the platform 50A may rest on the top of the middle support deck joist 52 and the angle iron 39A, 39B on the top of the applicable joists 30A, 30B, 30D. The configuration of the top of the middle support deck joist 52 and the angle iron 39A, 39B is such that vertical and horizontal movement of the platform 50A is avoided. The work platform 50 typically is sized to be a 4'×8' piece of material. The work platform 50A may include a wood panel 51A, for example. Suitable work platform 50 may be made from metal (e.g., steel, aluminum, etc.), wood, plastic, composite, or other suitable materials. Similarly, the work platform 50 may be made of items that are solid, corrugated, grated, smooth, or other suitable configurations. For example, the work platform 50 may be wood sheeting, plywood, roof decking material, metal on a frame, grating, steel sheeting, and the like. Thus, after placing a first work platform 50A on the work platform support system 100, an installer may continue in this manner and place additional multiple work platforms 50A, 50B, such as shown in FIG. 10, so that the entire support system 100 covered with wood platforms 51A, 51B so that a complete work platform system 120 is created.

Figure 11A:
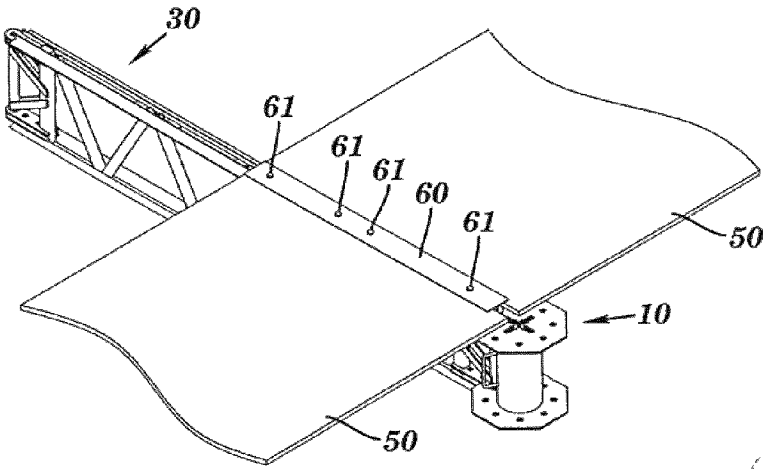
FIG. 11A is a top perspective view of a joist, hub, and portion of a deck retainer assembly, in accordance with the present invention.
Figure 11B:
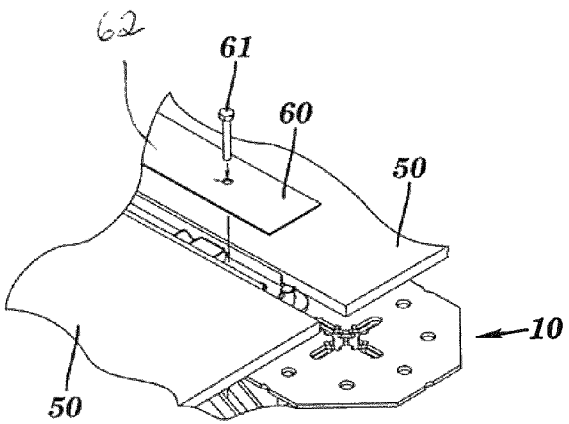
FIG. 11B is an exploded close-up perspective view of a joist, hub, and portion of a deck retainer assembly, in accordance with the present invention.
Figure 11C:
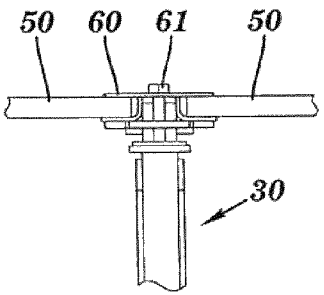
FIG. 11C is an end sectional view of a joist and a portion of a deck retainer assembly, in accordance with the present invention.

FIGS. 11A, 11B, and 11C show various close-up views of an additional, optional feature that may be provide as part of a work platform system 120. A deck retainer plate 60 may be placed over the spacing between the multiple work platforms 50. The deck retainer plate 60 may include a plurality of holes 62 so that a plurality of deck retainer bolts 61 may adhere the deck retainer plate 60 to the joist 30. The deck retainer plate 60 is one way in which to adhere work platforms 50 to the support system 100.

Figure 12:
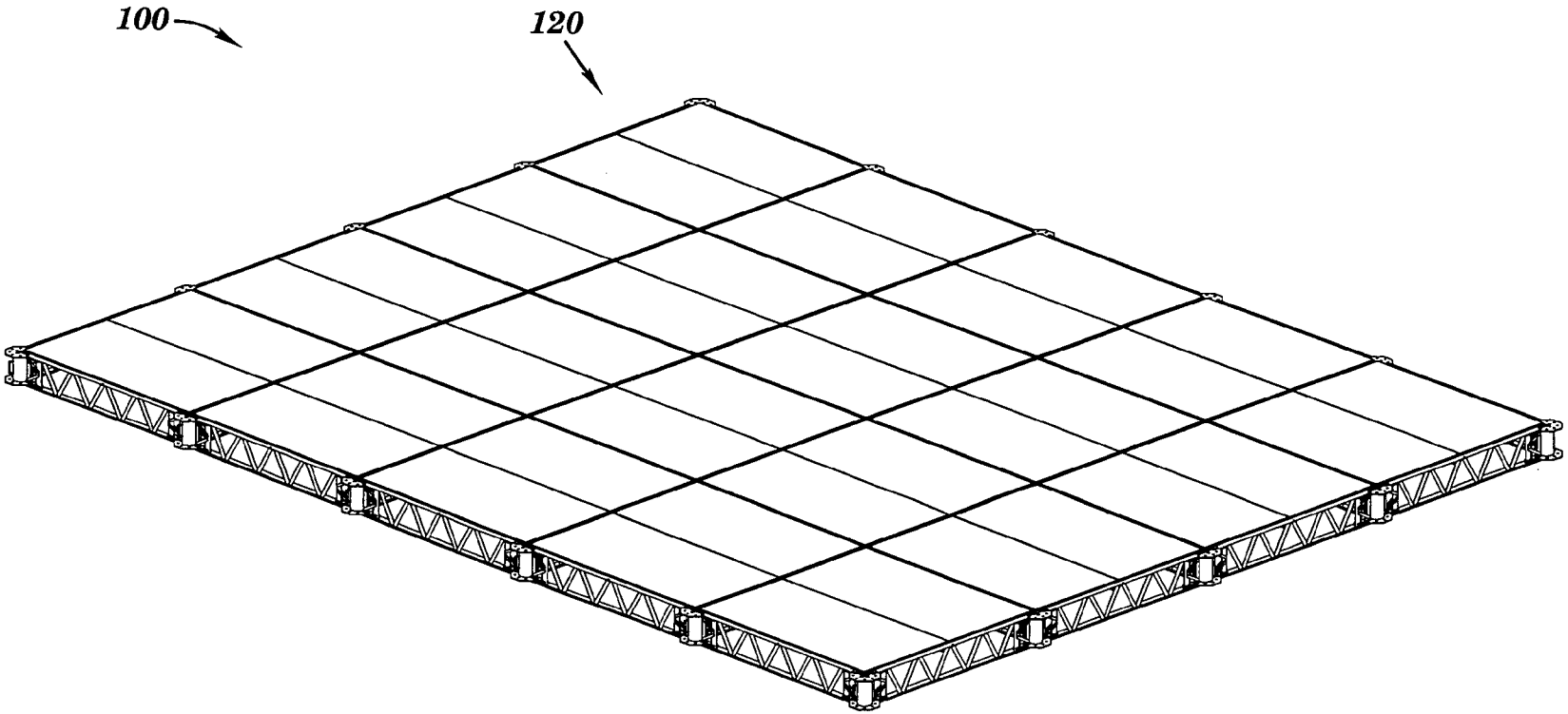
FIG. 12 is a top perspective view of a third embodiment of a work platform support system and work platform system, in accordance with the present invention.
Figure 13:
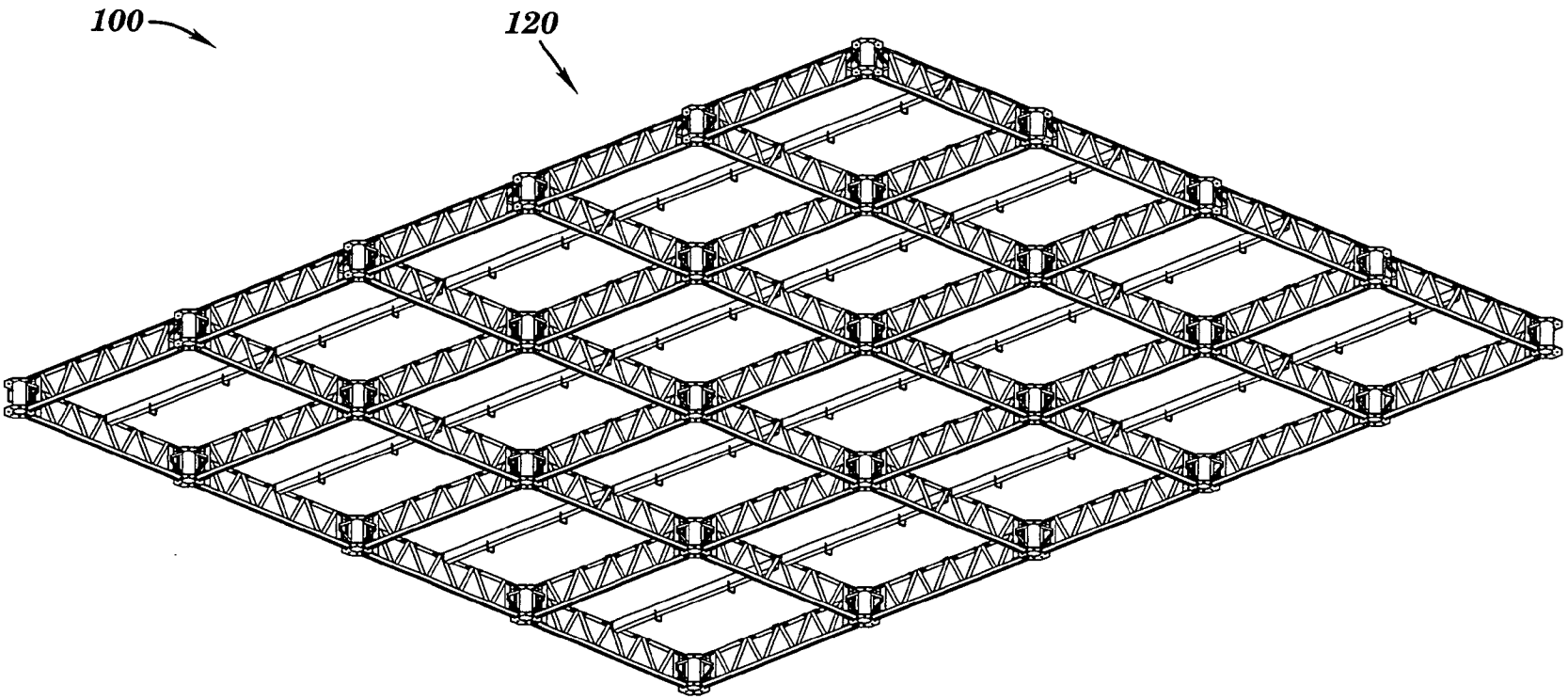
FIG. 13 is a bottom perspective view of the embodiment shown in FIG. 12, in accordance with the present invention.

As FIGS. 12 and 13 depict, there is virtually no limit as to the size and shape of the support system 100 and work platform system 120 that can be made with the present invention. FIGS. 12 and 13 show top and bottom perspective views, respectively, of one large rectangular embodiment of a support system 100 and work platform system 120.

As stated above, one deficiency of numerous existing work platforms are their inability to be installed in situ and also their inability to be relocated, extended, or removed, while a portion of the work platform is already installed in place. The present invention overcomes this deficiency. That is, the invention allows for a worker, or workers, to add on additional sections of support system 100 while this worker(s) is physically on an existing, installed portion of support system 100. That is the worker(s) can extend, relocate, or remove support system 100 with only the need of hand tools. No mechanical tools, hoists, cranes, or other equipment is required to add to, subtract from, or relocate the support system 100. This advantage, thus, offers savings in labor, time, and equipment.

Figure 14:
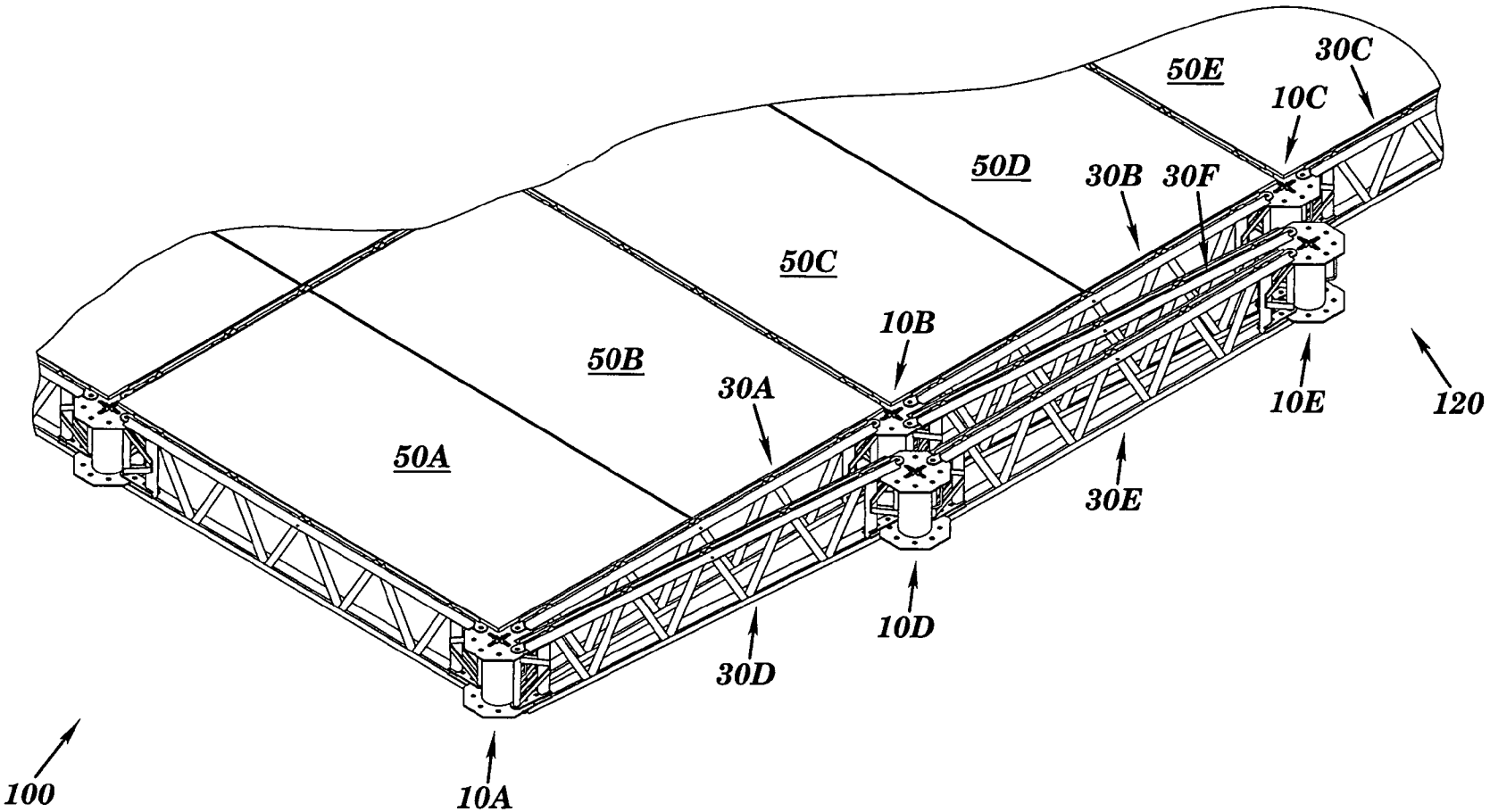
FIG. 14 is a top perspective view of a work platform system and a work platform support system prior to articulation, in accordance with the present invention.

For as FIGS. 14 through 18 depict the gradual articulation of just one section of work support system 100 into place. This can be readily accomplished by one, or two, workers by simply placing sequentially an additional joist 30D off of an existing hub 10A. Then a "new" hub 10D is connected to the first joist 30D. A second additional joist 30E is connected to the hub 30D. Further, another hub 10E and joist 30F are connected so that the final joist 30F is connected back to an existing hub 10B. In this manner, a worker(s) can install a new section of support system 100 (e.g., made up of "new" hubs 10D, 10E and "new" joists 30D, 30E, 30F) off of an existing section of support system 100 (e.g., made up of inter alia hubs 10Q, 10B, 10C and joists 30A, 30B). The worker(s) can install new, or relocate, sections of support system 100, while the worker remains on existing sections of work platform 50. That is, additional lift equipment, machinery is not required to install, relocate, or remove the additional support system 100 sections. Further, the installing worker(s) need not extend beyond the existing installed support system 100 or, they need only extend barely beyond the system 100. This allows the present invention to be safer than existing systems available, during installation, relocation, tear down, and movement. For example, as shown in FIG. 14, the installer(s) can be on the existing work platforms 50A, 50B, 50C, 50D when relocating, or installing, the next section(s) of the invention.

Figure 15:
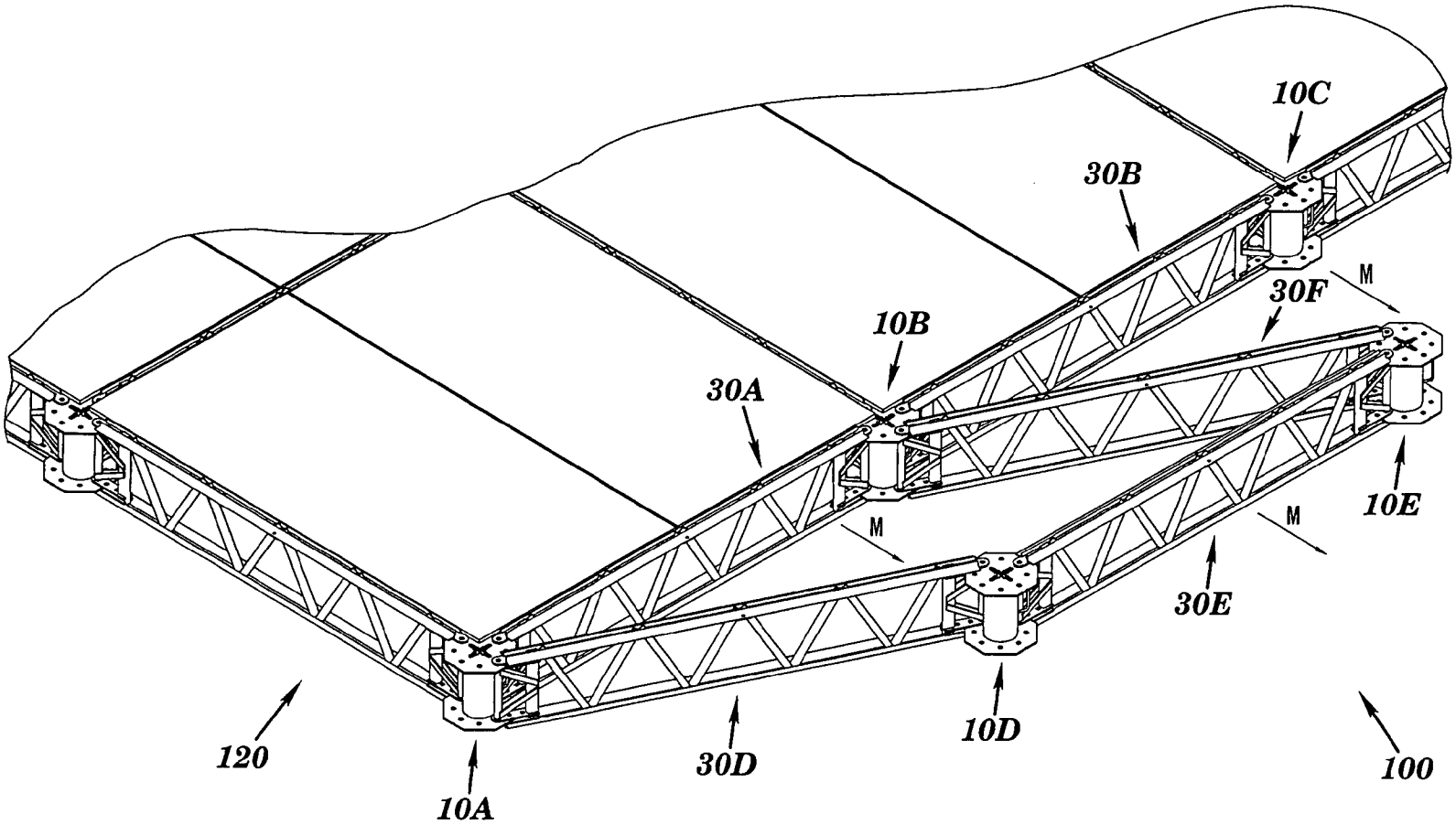
FIG. 15 is a top perspective view of the embodiment in FIG. 14 undergoing articulation, in accordance with the present invention.
Figure 16:
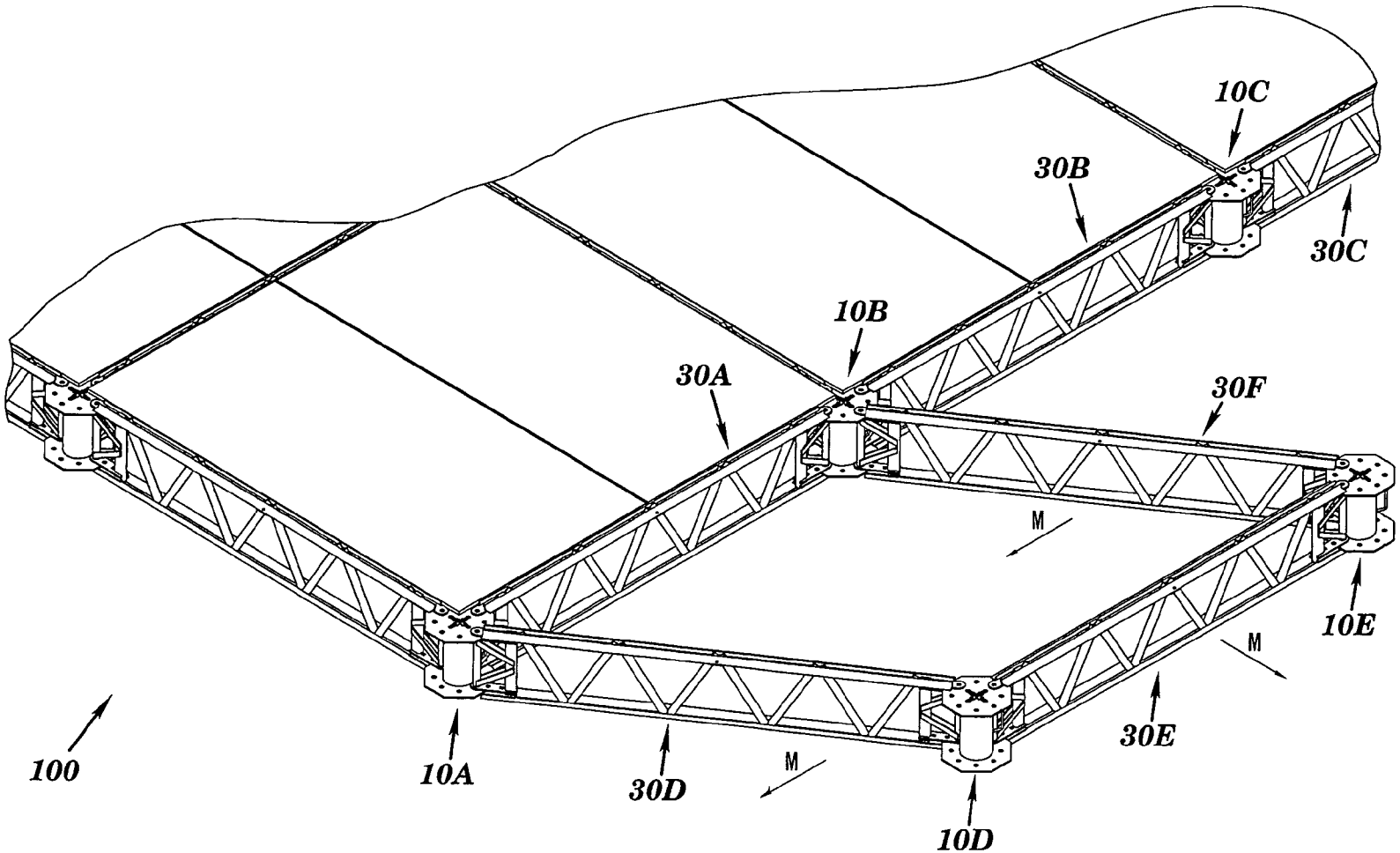
FIG. 16 is a top perspective view of the embodiment in FIG. 15 undergoing further articulation, in accordance with the present invention.
Figure 17:
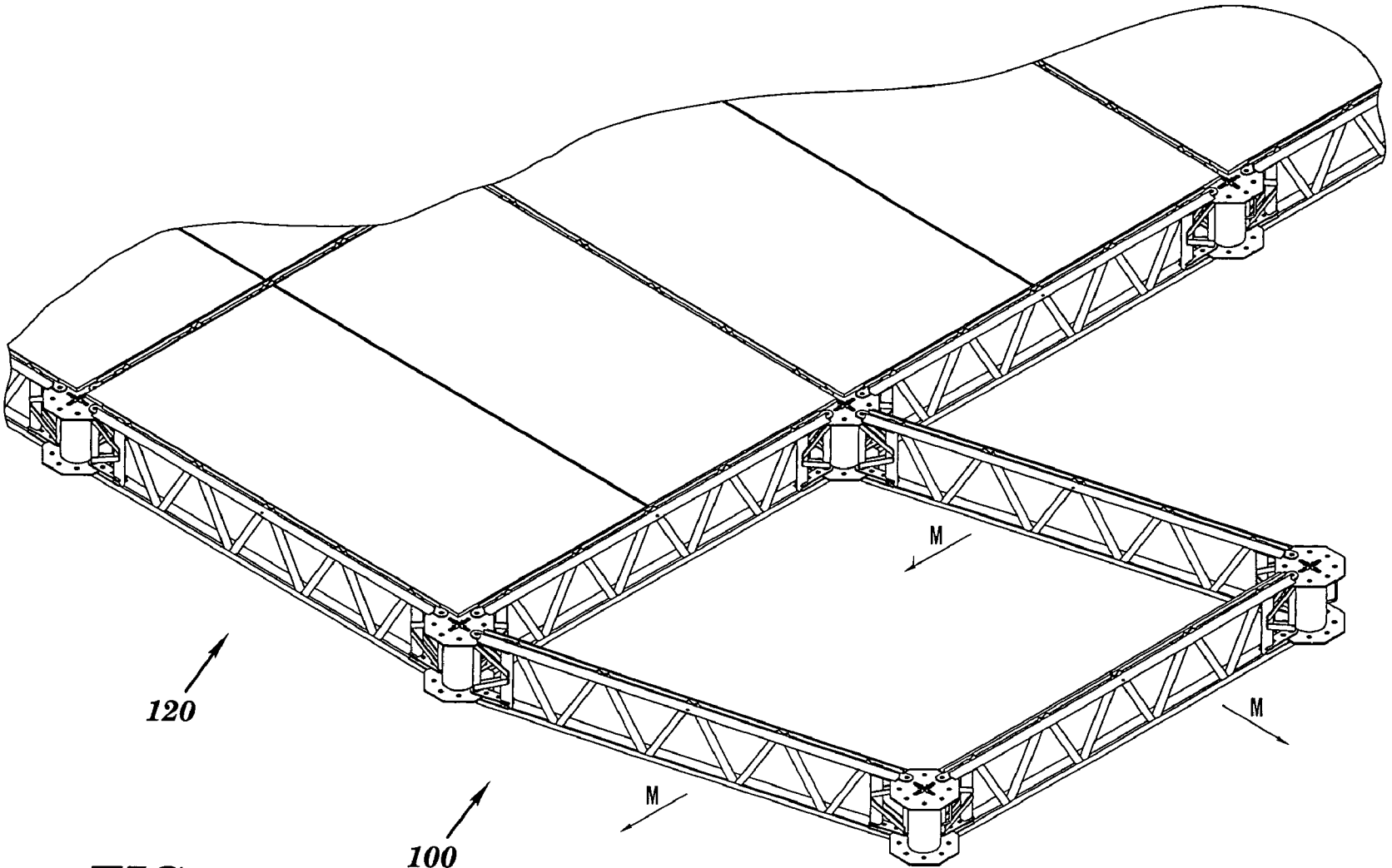
FIG. 17 is a top perspective view of the embodiment in FIG. 16 undergoing further articulation, in accordance with the present invention.

As FIGS. 15 through 17 clearly show via the motion arrows "M", that by a combination of rotation of the new joists 30D, 30E, 30F and new hubs 10D, 10E, that the new section of work support system 100 is able to move and rotate into its final requisite location. That is, the supports system 100 articulates into place. Further, the articulation can be initiated and stopped (and even reversed) by an installer(s) while the installer(s) remains on the pre-existing support system 100. Although not shown, additional supplemental devices to aid in the articulation (e.g., motors, hand tools, mechanical tools, hydraulics, etc.) can be used.

Figure 18:
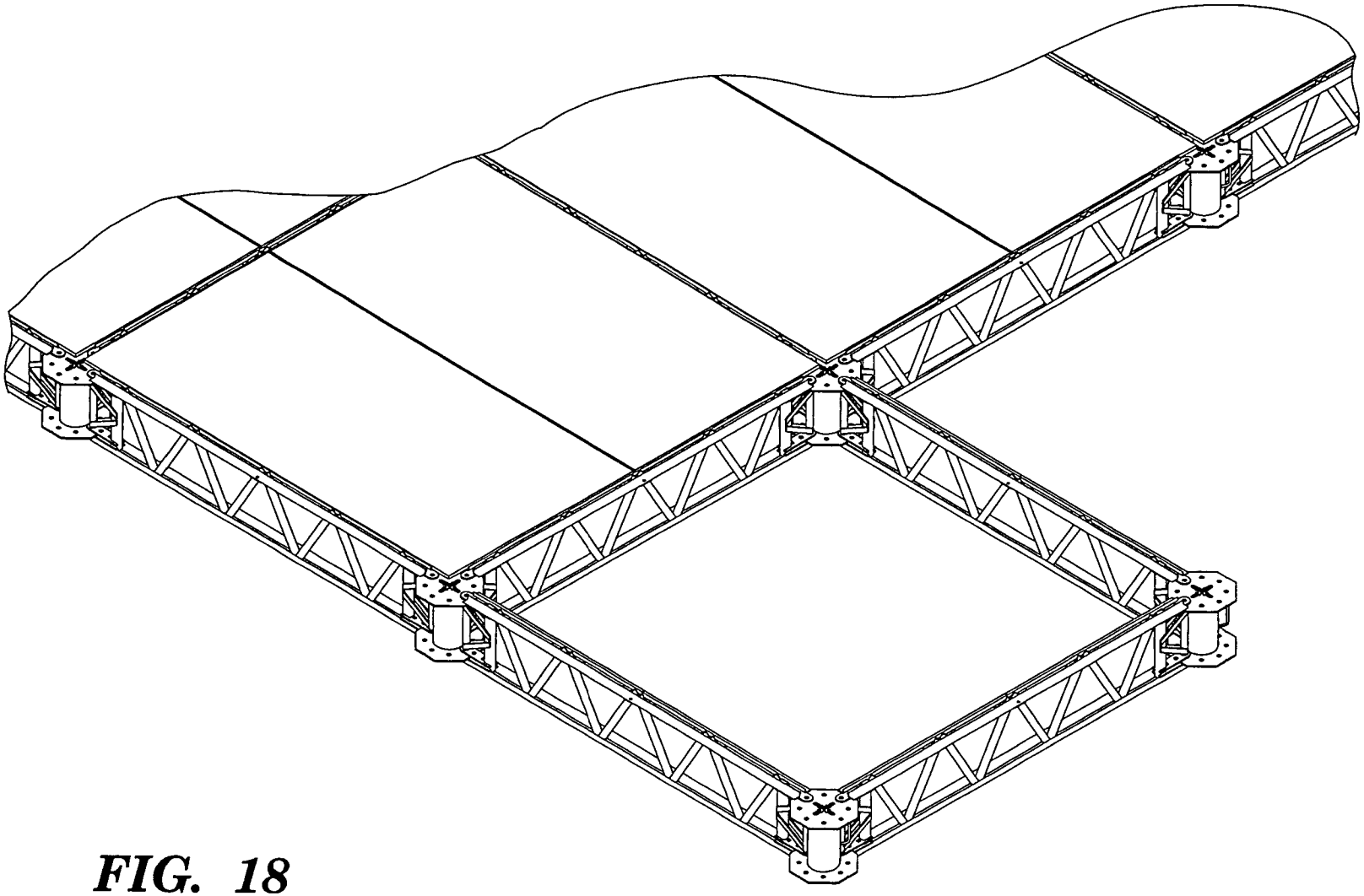
FIG. 18 is a top perspective view of the embodiment in FIG. 14 having completed articulation, in accordance with the present invention.

FIG. 18 shows a new section of support system 100 articulated into place, prior to the installation of support platform(s) 50 and other pieces, as discussed supra (See e.g., FIGS. 8A, 8B, 8C, 9, 10, 11A, 11B, 11C, 12). The removal of a portion of the support system 100 can essentially be done by reversing the aforementioned steps.

Although the present invention, as discussed, may be installed, and extended, via the aforementioned articulation capability, it should be apparent that this method of use is not the only method available. For example, in lieu of articulating the various modules, or sections, of support system 100 from already installed section of support system 100, the installation may be done, essentially, "in the air". That is, the system 100 may erected and connected together "in the air", in a piece-by-piece order via the use of multiple pieces of lifting, or hoisting, equipment. Alternatively, the hubs 10 and joists 30 may be preassembled on the ground, or at a remote location, and then moved and hoisted as a pre-assembled module into the desired location underneath a structure.

With reference to the teachings herein, including at least FIGS. 6A, 9 and 14-18, it is apparent that at least one of the joists is to be connected with at least one of the hubs using a pin to provide free rotation of the at least one joist with respect to the at least one hub about the pin. Moreover, it is apparent that the free rotation is restricted by at least one of: i) an additional pin that is to be located proximate a perimeter of the at least one hub; and ii) at least a portion of a work platform when the platform is positioned with respect to the hubs and the joists in the final position.

Figure 19A:
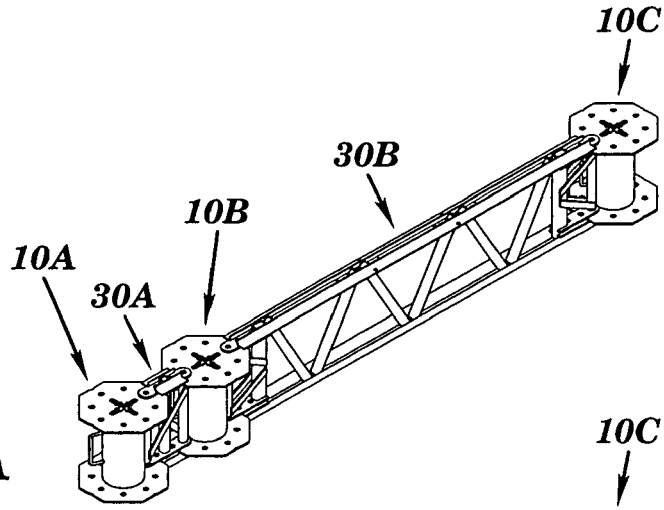
FIG. 19A is a top perspective view of a joist and hub assembly, in accordance with the present invention.
Figure 19B:
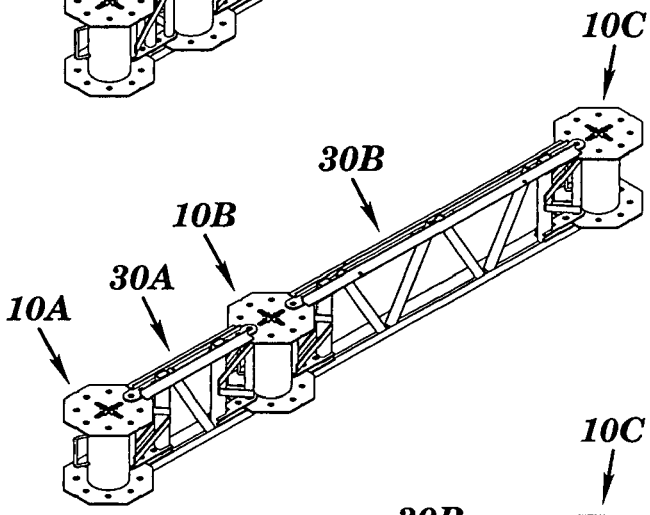
FIG. 19B is a top perspective view of a second embodiment of a joist and hub assembly, in accordance with the present invention.
Figure 19C:
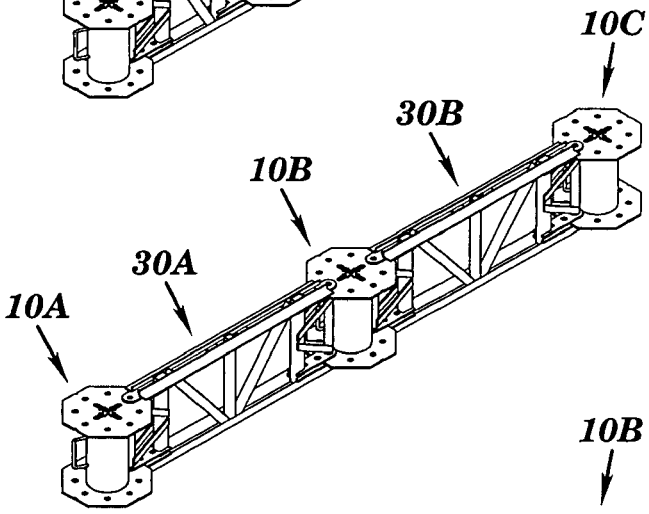
FIG. 19C is a top perspective view of a third embodiment of a joist and hub assembly, in accordance with the present invention.
Figure 19D:
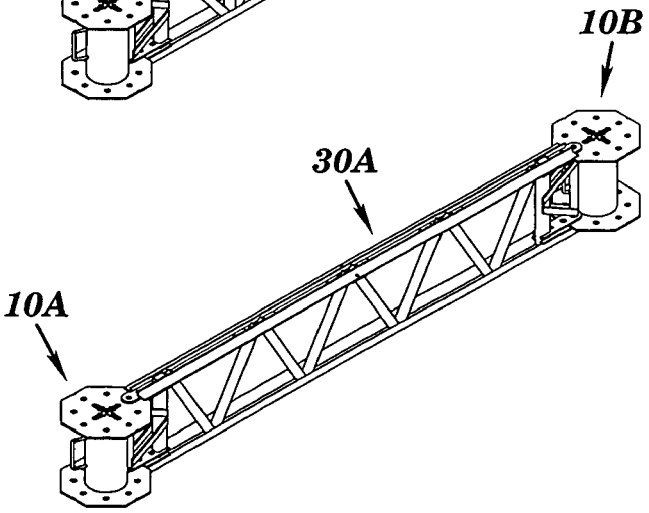
FIG. 19D is a top perspective view of a fourth embodiment of a joist and hub assembly, in accordance with the present invention.

FIGS. 19A, 19B, 19C 19D show various embodiments of a joist 30 and hub 10 configuration. For example, FIG. 19D shows a "standard" length joist 30A (e.g., 8 foot nominal length) with two hubs 10A, 10B. This "standard" length joist 30A could be termed a "6/6 unit". FIG. 19C shows two joists 30A, 30B of equal length connected to hubs 10A, 10B, 10C. The joists 30A, 30B in FIG. 19C, being half the length, each of the length of the joist 30A in FIG. 19D, may be termed a "3/6 unit" in that they are half the length of the aforementioned "6/6 unit". Similarly, two unequal length joists 30A, 30B are depicted in FIG. 19B, and can be termed a "2/6 unit" and a "4/6 unit", respectively. This is because the "2/6 unit" is approximately one third the length of a "standard" "6/6 unit" joist as shown in FIG. 19D, as is the "4/6 unit" is approximately two thirds the length of the "6/6 unit". The same system is shown in FIG. 19A, wherein the first joist 30A is termed a "1/6 unit" and the second joist 30B is termed a "5/6 unit". As stated above, by using different lengths of joist 30, and by extending joists 30 from hubs 10 at different angles, one can obtain a nearly infinite variety of configurations and footprints of the support systems 100. This variety, for example, allows the installer to set up the support system 100 around various obstacles (e.g., columns, piers, abutments, etc.) and structures. The variety allows the installer to create numerous shapes to the work platform system 120 beyond just a rectangle.

Figure 20A:
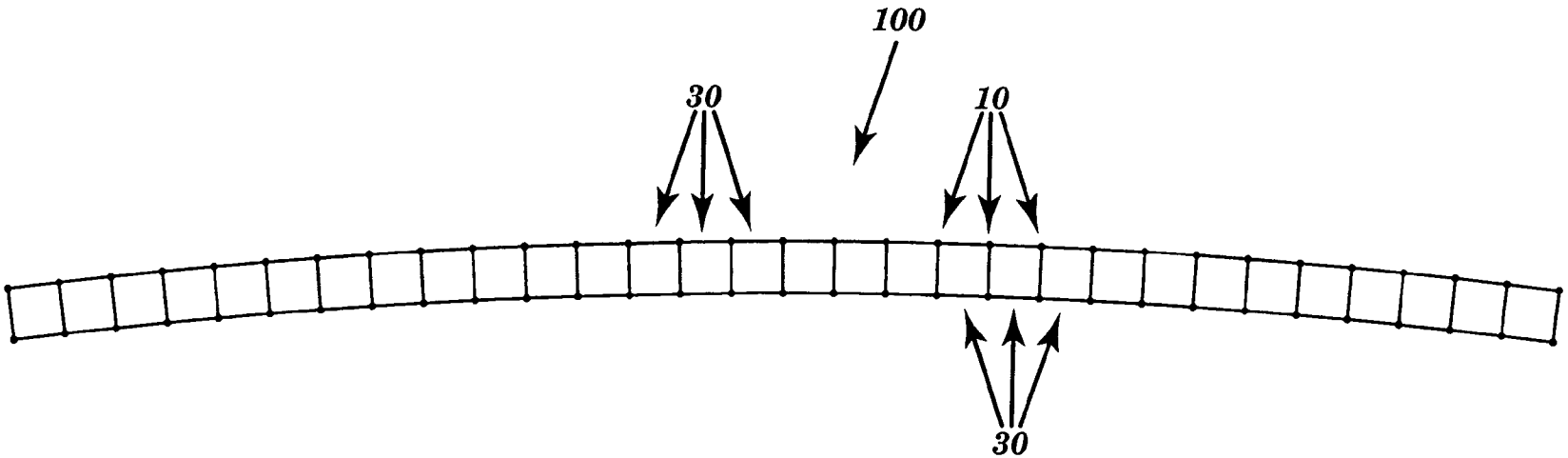
FIG. 20A is a plan view of a curved work platform support system, in accordance with the present invention.
Figure 20B:
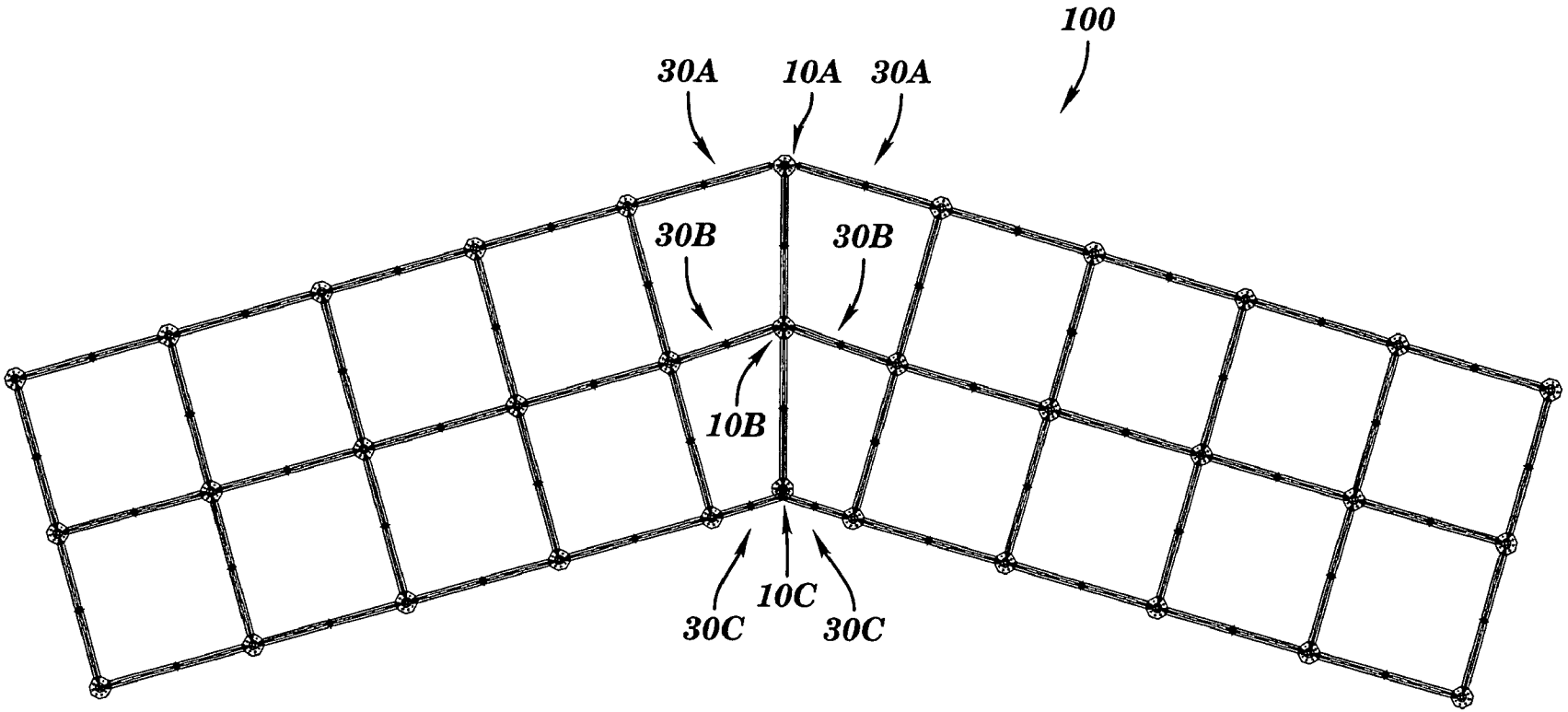
FIG. 20B is a plan view of an angled work platform support system, in accordance with the present invention.

FIGS. 20A and 20B depict the plan view of just two embodiments of the invention. In these figures it can be seen that the work platform support system 100 is capable of various horizontal alignments. For example, FIG. 20A shows 8 foot length joists 30 interconnected with a plurality of hubs 10. Due to spacing between the pin 40 and hub 10, some flexibility is provided in the system 100 so that the system 100 can be curved, or "racked", in the horizontal direction. This can help allow the system 100 to be installed around structures. FIG. 20B depicts a system 100 that is angled. For example, the joists 30C connected to hub 10C can be shorter than joists 30B connected to hub 10B. Joists 30B, in turn, are shorter than joists 30A, which are connected to hub 10A. In this fashion, by using joists 30A, 30B, 30C of different length and/or altering the angle at which a joist 30 is connected to a hub 10, systems 100 that are angled, as in FIG. 20B can be configured. Similarly, this allows the system 100 to be installed, for example, around various impediments, structures, and the like.

Figure 21C:
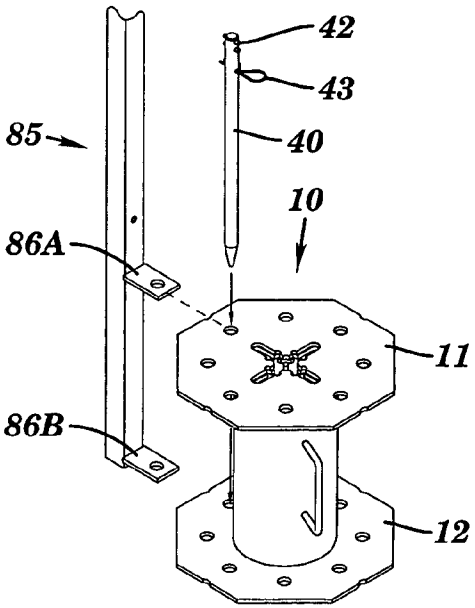
FIG. 21C is an exploded view of FIG. 21B, in accordance with the present invention.
Figure 21B:
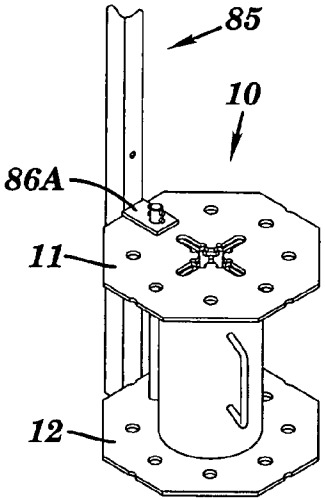
FIG. 21B is a close-up of FIG. 21A, in accordance with the present invention.
Figure 21A:
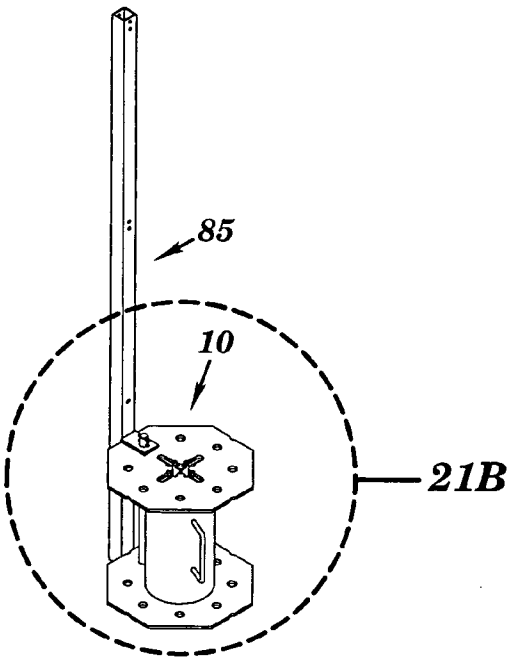
FIG. 21A is a top perspective view of an interconnection between a hub and a railing standard, in accordance with the present invention.

FIGS. 21A through 22C show various connection details as to how a railing system can be attached to the present invention. FIGS. 21A, 21B and 21C show the interconnection between a railing standard 85 and the hub 10. The railing standard 85 is typically elongate an includes a first flange 86A, and a second flange 86B extending therefrom for connection to the hub 10. The first flange 86A has a hole in it, as does the second flange 86B. By leading the pin 40 through the upper flange 86A, then through holes 13 in the upper element 11 down through the lower flange 86B, and then through the holes 14 in the lower element 12 an installer is able to attach the railing standard 85 to the hub 10 of the support system 100. The pin 40 may includes various devices, such as roll pins 42 and a holding loop 43. In this manner, a plurality of railing standards 85 may be attached to a plurality of hubs 10, creating a railing system around the work platform system 120 so as to meet the regulations promulgated by OSHA.

Figure 22C:
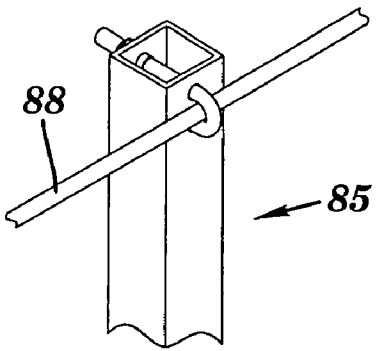
FIG. 22C is a close up top perspective view of an interconnection between a railing standard and railing, in accordance with the present invention.
Figure 22B:
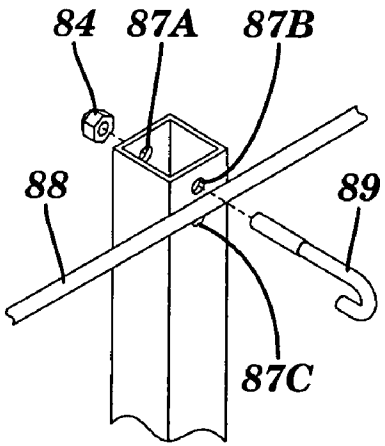
FIG. 22B is an exploded view of FIG. 22C, in accordance with the present invention.
Figure 22A:
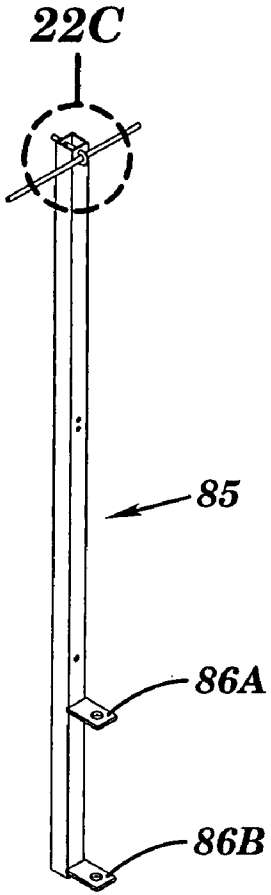
FIG. 22A is a top perspective view of a railing standard and railing, in accordance with the present invention.

FIGS. 22A, 22B, 22C depict various views of a railing standard 85 and its interconnection with a railing 88. The railing 88 can be a variety of materials, such as chain, cable, line, and the like. For example, the railing 88 may be galvanized aircraft cable. The railing standard 85 includes a plurality of holes 87. As the exploded view in FIG. 22B shows, a J-bolt 89 may be used with a nut 84 to attach the railing 88 to the railing standard 85. By attaching a plurality of railings 88 to the plurality of railing standards 85 a railing system that meets the OSHA regulations is made. For example, an additional railing 88 may be added at the midpoint of the railing standard 85. In other embodiments, the railing standards 85 can also be used to erect a work enclosure system. For example, tarps, sheeting, or the like could be attached to the railing standards 85 to enclose the work area for painting, demolition, asbestos or lead paint abatement, and similar activities where the workers do not want any escape of fumes, paint, hazardous materials, debris, etc. from the work area.

Figure 23:
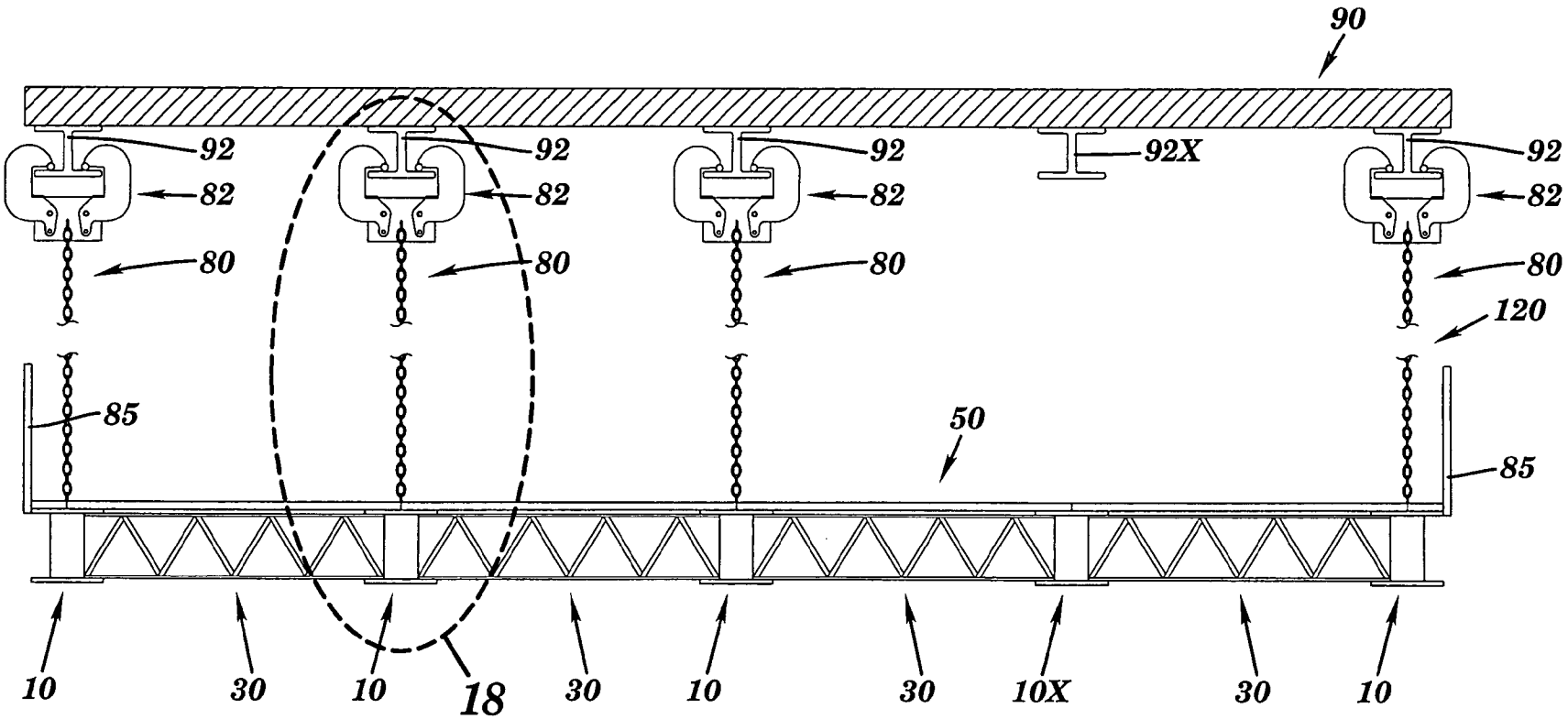
FIG. 23 is a sectional elevation view of a work platform support system and work platform system attached to a structure, in accordance with the present invention
Figure 24A:
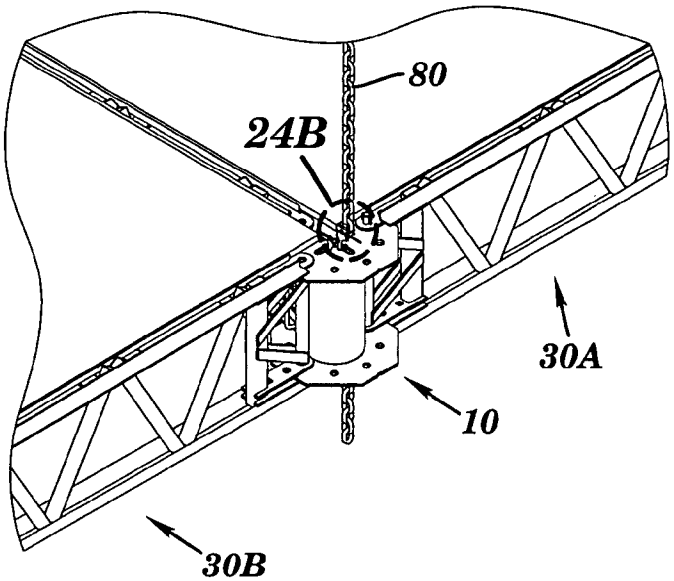
FIG. 24A is a top perspective view of an interface between a hub and a suspension connector, in accordance with the present invention.
Figure 24B:
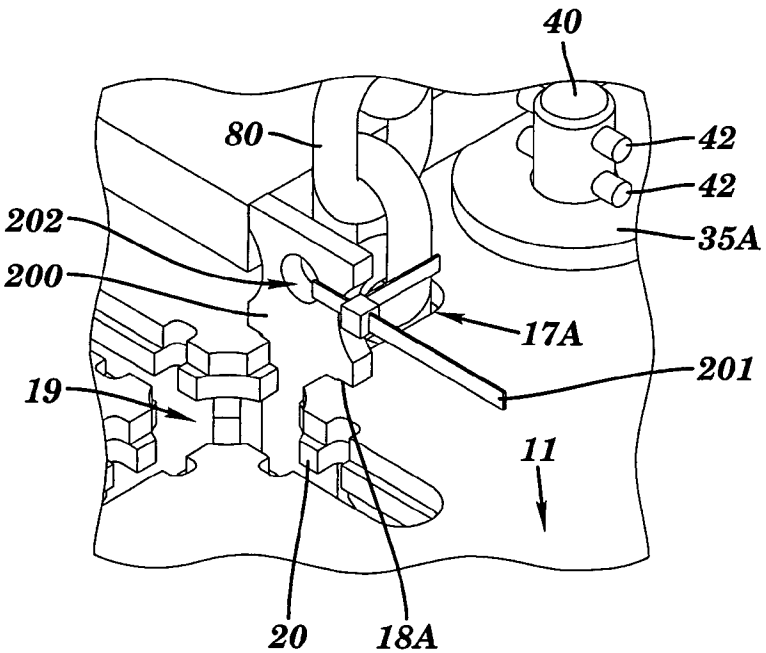
FIG. 24B is a close-up the interface shown in FIG. 24A, in accordance with the present invention.
Figure 25B:
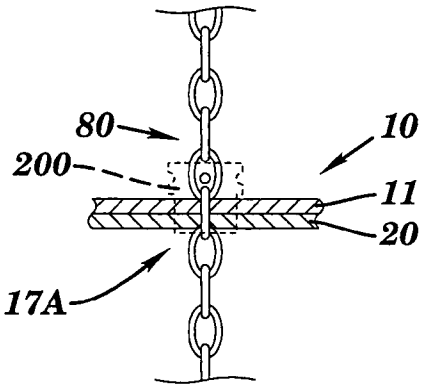
FIG. 25B is a close-up sectional elevation view the interconnection between the hub and suspension connector, in accordance with the present invention.
Figure 25A:
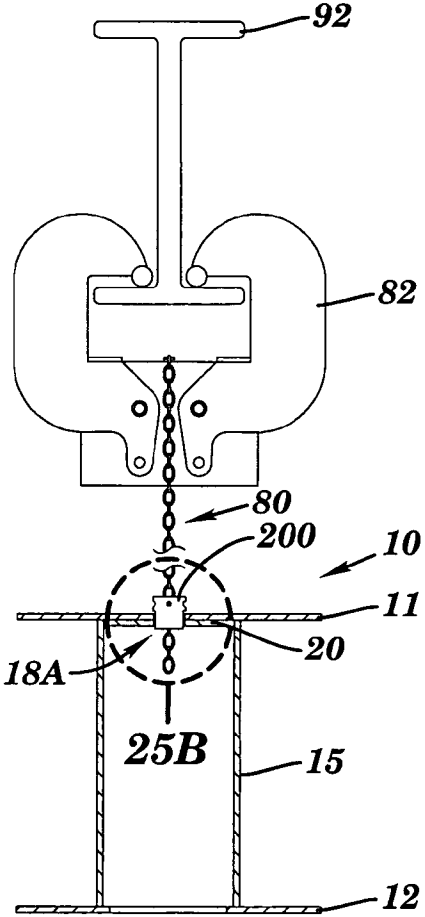
FIG. 25A is a sectional elevation view of a hub, suspension connector, and structure attachment device, in accordance with the present invention.
Figure 26A:
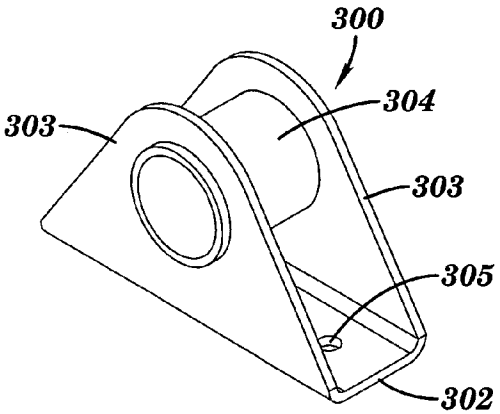
FIG. 26A is a top, perspective view of an auxiliary suspender mounting bracket, in accordance with the present invention.
Figure 26C:
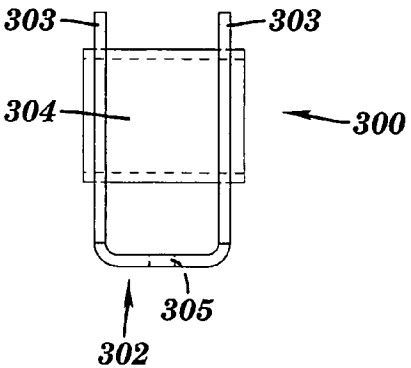
FIG. 26C is a front elevation view of an auxiliary suspender mounting bracket, in accordance with the present invention.
Figure 26B:
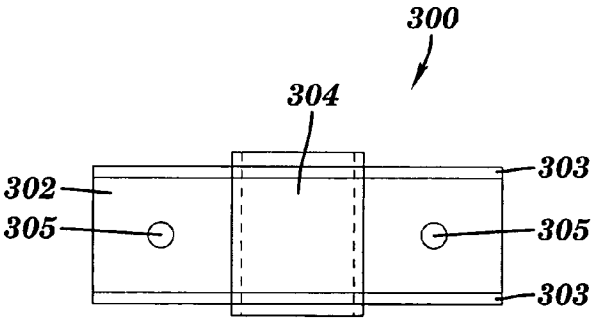
FIG. 26B is a plan view of an auxiliary suspender mounting bracket, in accordance with the present invention.
Figure 26D:
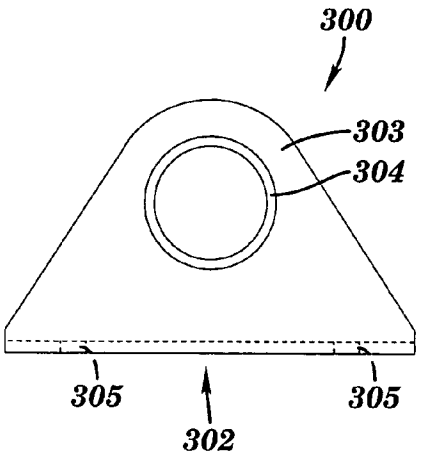
FIG. 26D is a side elevation view of an auxiliary suspender mounting bracket, in accordance with the present invention.

FIG. 23 shows an elevation sectional view of one embodiment wherein a support system 100 and work platform system 120 are attached, via a suspension connector 80, to a structure 90. The structure 90 in this embodiment is a bridge 90. On the underside of the bridge 90 are a plurality of beams 92. A series of suspension connectors 80, in this embodiment high strength chains, are attached to several of the beams 92 via structure attachment device 82, in this embodiment standard beam clamps. At the perimeter of the work platform system 120 are a plurality of railing standards 85, thereby creating a railing system around the work platform system 120. The plurality of chains 80 are attached to various hubs 10 in the support system 100 thereby providing structural connection to the bridge 90. In this manner, a work platform system 120 and support system 100 can be fully suspended from a suitable structure 90. Note that each hub 10 does not necessarily require a suspension connector 80 to be connected to the structure 90. For example, there is no suspension connector 80 connecting hub 10X to beam 92X. This may be because hub 10A does not line up underneath beam 92X, or other suitable suspension point, and thus, using a chain 80 in that location is either not possible, or not desirable.

The suspension connector 80 may be any suitable support mechanism that can support both the work platform system 120, and all its ancillary dead loads, plus any intended live load that is placed upon the work platform system 120. In fact, the work platform system 120 may support its own weight plus at least four times the intended live load that is to be placed on the work platform system 120. Similarly, the suspension connector 80 is also suitable to support its own weight plus at least four times the intended live load placed on it. The suspension connector 80 may be a high-strength chain, cable, or the like. For example, one suitable suspension connector 80 is ⅜", grade 100, heat-treated alloy chain.

The suspension connector 80 is attached to a beam clamp 82 which is further attached to a plurality of elements 92 on the underside of a structure 90. The structure 90 may be a bridge, viaduct, ceiling structure of a building, or the like. Similarly, the elements 92 which the suspension connector 80 are attached to may be beams, joists, or any other suitable structural element of the structure 90. Instead of beam clamps 82, other suitable structure attachment devices 82 may be used.

FIGS. 24A, 24B, 25A, 25B all depict various views of the interconnection between the suspension connector 80 (e.g., chain, cable, etc.) and the hub 10. In the embodiment shown, a free end of the chain 80 (i.e., end distal to structure 90) is placed through the center opening area 19 of the top element 11 of the hub 10. The chain 80 is then slid over and in to one of the four slots 17 (e.g., 17A). Once the chain 80 is place within slot 17A, a chain retainer pin 200 is placed in the adjacent transverse slot 18A so that the chain 80 kept retained in the distal end of slot 17A. The chain 80 and slot 17A are sized and configured so that upon proper placement of the keeper pin 200 with in the transverse slot 18A, the chain 80 is effectively locked to the hub 10 and is unable to slip, vertically or horizontally, from its position in 17A. This locking system effectively fixes the hub 10 to the chain 80. As an added safety check, a zip tie 201 may be placed between a hole 202 in the chain retainer pin 200 and an adjacent link in the chain 80. This further provides a visual aid to the installer to ensure that the chain retainer pin 200 has been installed.

An alternative device for connecting a suspension connector 80 to the work platform support system 100 is a an auxiliary suspender mounting bracket 300. The auxiliary mounting bracket 300 is typically used when a particular hub 10 can not be accessed for connection with a suspension connector 80. As the various FIGS. 26A, 26B, 26C, and 26D depict, one embodiment of the auxiliary suspender mounting bracket 300 includes two opposing and parallel flanges 303. Spanning the flanges 303 is an interconnecting tube 304 and a base plate 302. Through the base plate 302 are a plurality of mounting holes 305. The auxiliary suspender mounting bracket 300 can be used in lieu of, or in addition to, the hub 10 for a suspension point. The bracket 300 allows a suspension connector 80 to be connected to the system 100 at locations other than a hub 10.

Figure 27:
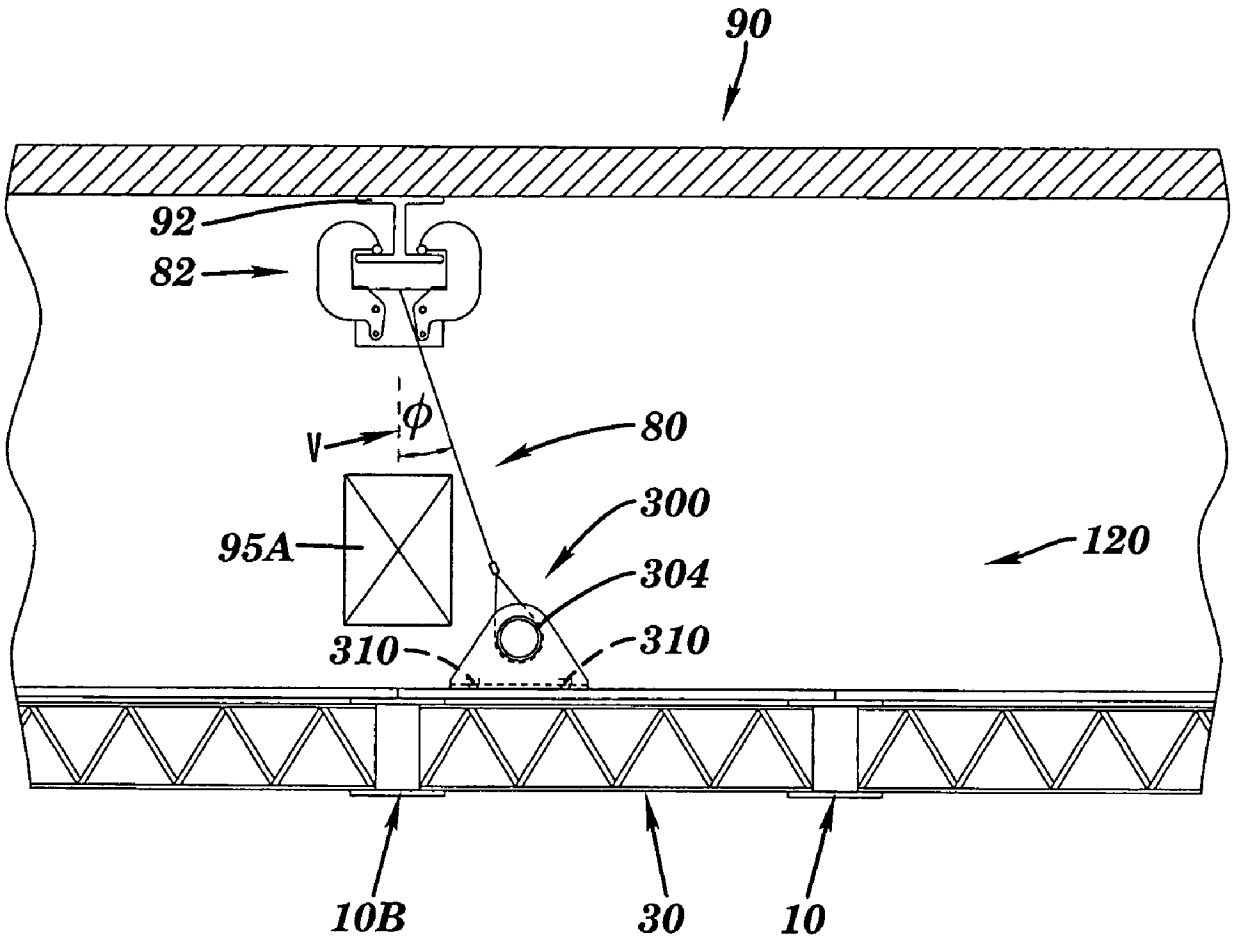
FIG. 27 is an elevation sectional view showing suspension of a work platform system from a structure via an auxiliary suspender mounting bracket, in accordance with the present invention.

For example, FIG. 27 depicts a scenario that may typically be encountered when installing a work platform system 120. Note that FIG. 27 is not drawn to scale. One or more obstructions 95A may be located on the underside of the structure 90, or between the structure 90 and the work platform system 120. These obstruction(s) 95A may be man-made, or natural. For example, the obstructions 95A may be concrete beams, box-beams, inadequately sized framework, ductwork, lighting, finished surfaces, and the like. The obstructions 95A are such that a particular hub 10B is not practical, or possible, as a connecting point for the system 120 to a suspension connector 80. In this case, one or more auxiliary suspender mounting brackets 300 may be attached to a joist 30. High strength bolts (not shown) may be passed through the mounting holes 305 and then through holes on an upper element 32 and connected to bolts below the upper element 32. (See for similar connection detail the connection of plate 60 in FIG. 11B). The suspension connector 80 (e.g., chain) may be connected, via a beam clamp 82, to a beam 92 that is on the underside of the structure 90.

As shown in FIG. 27, obstruction 95B is directly vertically over hub 10B, thereby rendering hub 10B inadequate for a suspension point. Thus, a bracket 300 can be attached to a joist 30 adjacent to hub 10B, thereby allowing a suspension connector 80 to get proper attachment to a nearby beam 92. The angle, $\phi$. between the suspension connector 80 and vertical, denoted by V, allows for the suspension connector 80 to be either non-vertical, or slightly off of vertical.

Figure 28A:
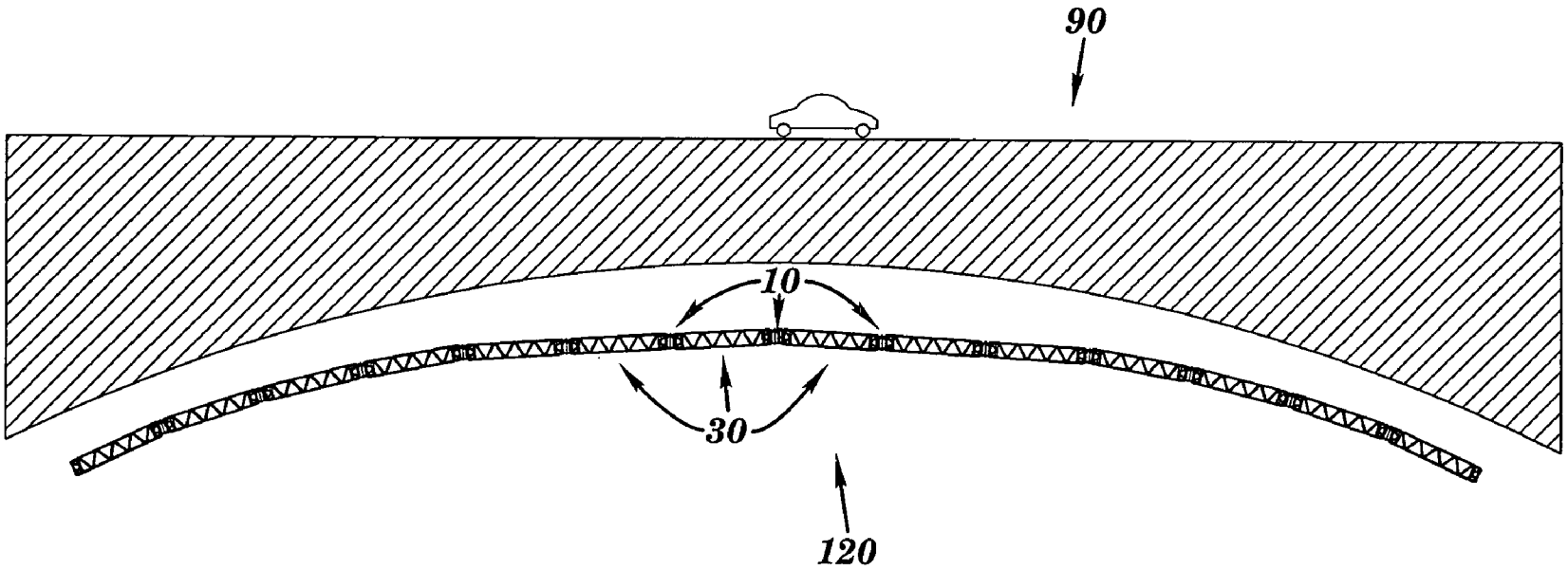
FIG. 28A is an elevation view of a work platform system suspended under an arched bridge, in accordance with the present invention.
Figure 28B:
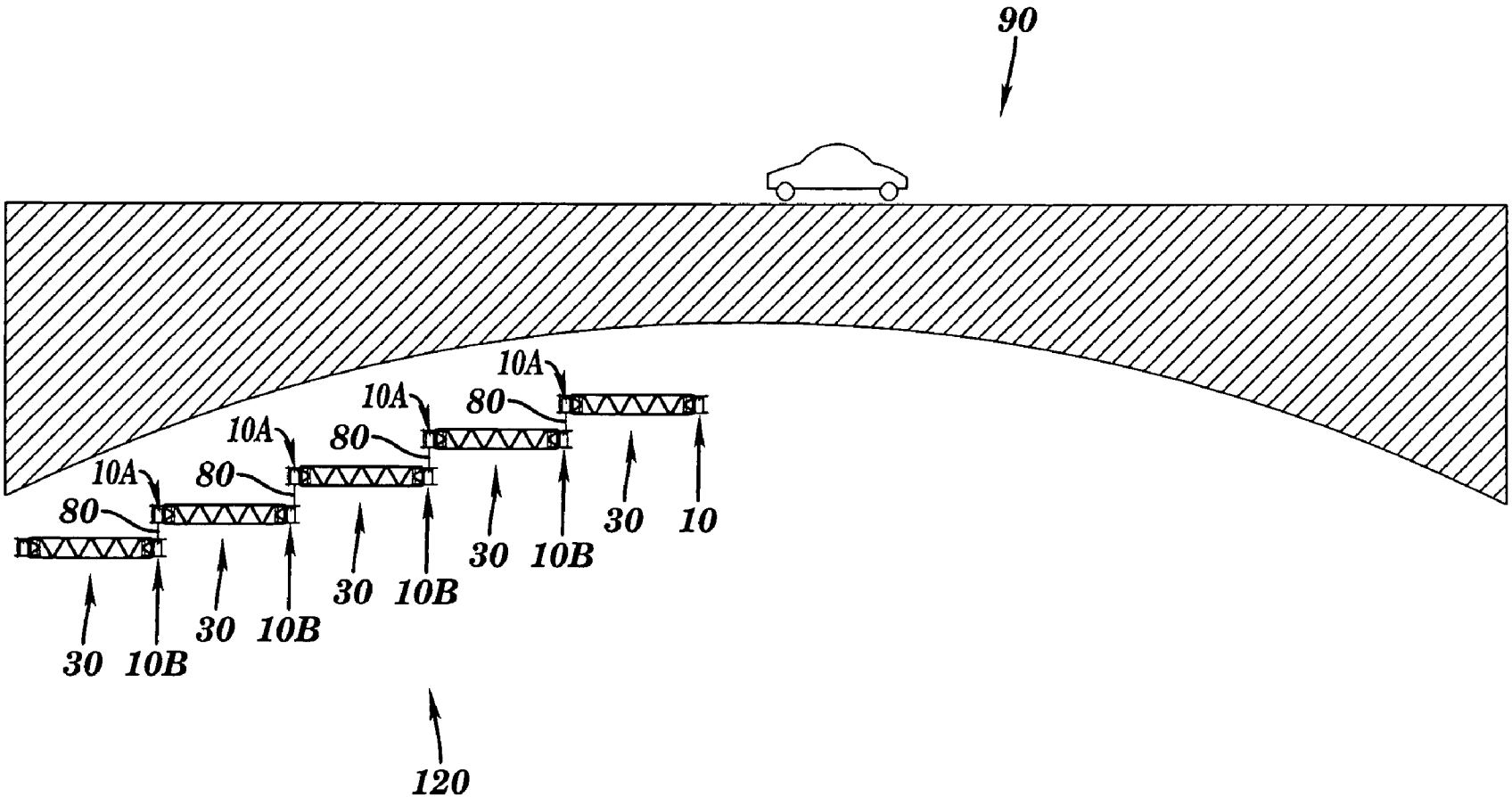
FIG. 28B is an elevation view of a second embodiment of a work platform system suspended under an arched bridge, in accordance with the present invention.
Figure 28C:
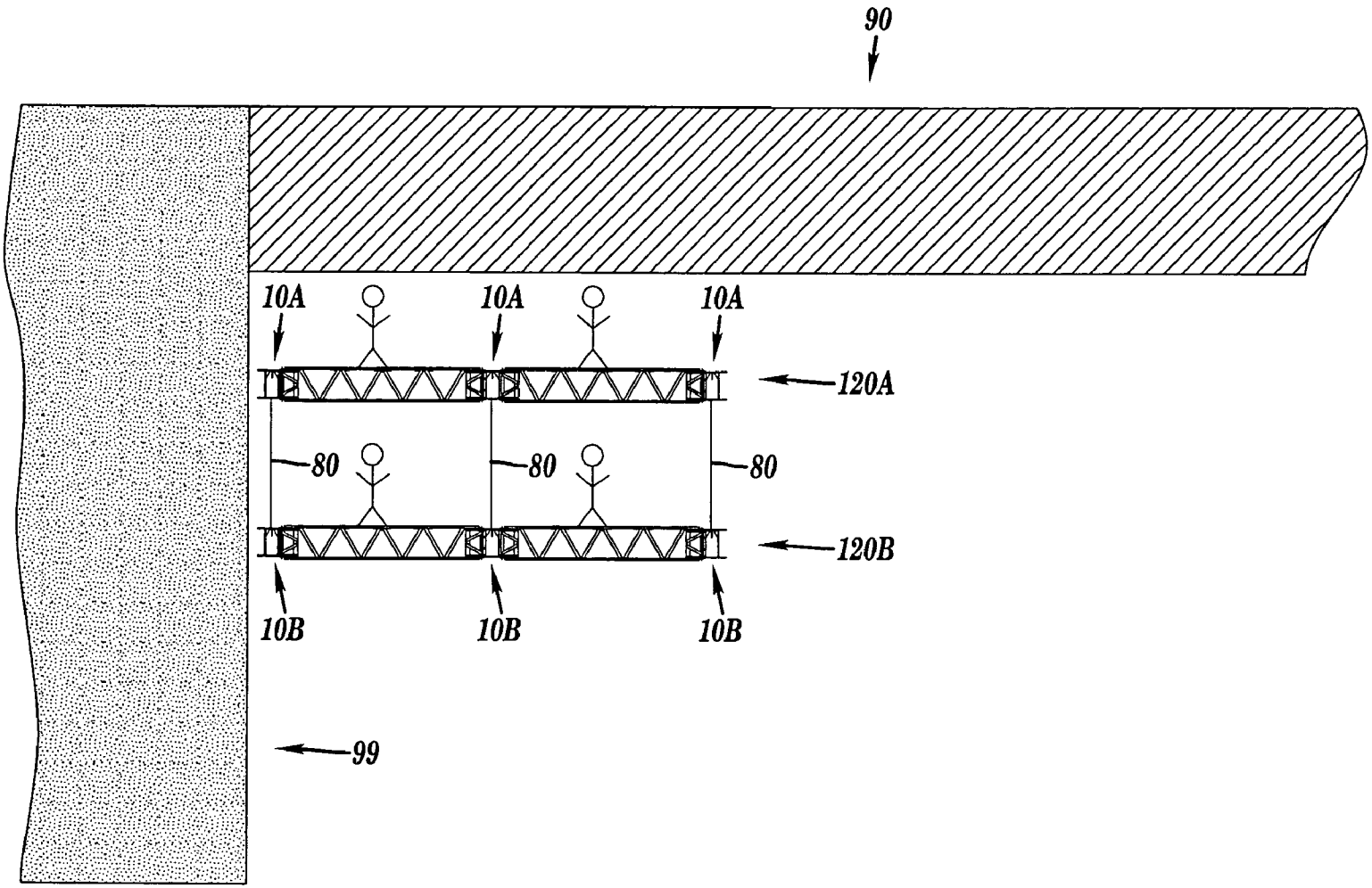
FIG. 28C is an elevation view of a multi-leveled work platform system suspended under a structure, in accordance with the present invention.

FIGS. 28A, 28B, and 28C show elevation views of various embodiments wherein the vertical flexibility of the present invention is apparent. For example, FIG. 28A shows a portion of a work platform system 120 suspended from the non-flat underside of a structure 90 (e.g., arched bridge). The suspension connector 80 and other connection details are not shown for ease of illustration. There is flexibility, due to the design, in the interconnections between hub 10 and joist 30. This flexibility allows for some bendability in the vertical direction (See e.g., FIG. 28A). This allows the system 120, for example, to parallel, or "mirror", the underside of a curved, arched bridge.

Alternatively, should the curvature of the supporting structure 90 be even greater, a configuration such as shown in FIG. 28B can be installed. That is multiple portions of the system 120 are not co-planar, but rather stepped, or tiered. If required, various suspension connectors 80 may be installed of such length so that multiple hubs 10A, 10B may be installed to the same suspension connector 80. As discussed above, the suspension connector 80 may be connected to a slot 17 of the upper hub 10A, then passed through the bottom opening 23 of the upper hub 10A and then connected also to a slot 17 of the lower hub 10B (See e.g., FIGS. 24A, 24B).

As FIG. 28C shows another configuration of the present invention is the capability to install the system 120 in a multi-level configuration. For example, where work perhaps needs to be done on a vertical structure 99 (e.g., bridge pier), at least two systems 120A, 120B may be installed. Similar to the connection scenario used in FIG. 28B (above), suspension connector 80 can, again, be of suitable length so as to pass from hubs 10A on the upper system 120 on to, and also connect up to, the hubs 10B on the lower system 120. In this manner, multiple levels of system 120 may be installed in a vertical orientation.

Load Testing:

The present invention is capable of supporting its own weight and at least four times the intended live load applied, or transmitted, upon the work platform system 120. Various load tests were conducted on the present invention. See e.g., FIG. 26.

For example, one uniform load test was conducted on a 8 foot×8 foot module of a work platform system 120. In this load test, a two (2) 4'×8' sheets of ¾" BB OES Plyform decking served as the platform 50. The platform 50 (i.e., Plyform) was installed as discussed above. The work platform system 120 included standard hubs 10, joists 30, supports 52, and the like, as discussed above. One of the two sheets of Plyform was uniformly loaded with a plurality of steel plates. Each plate was ½"×12"×30", and weighed 50 pounds. Twelve (12) plates were arranged per layer on the platform 50. A total of 256 plates were added, producing a total live load of 12,800 pounds, or 400 PSF (i.e., pounds per square foot). Further, the Plyform platform 50 was thoroughly soaked with water while the full weight of the plates on it. The test was witnessed and there was no failure of the Plyform after being loaded for over twenty four hours. In conclusion, by using ¾" BB OES Plyform as the platform 50 in the present invention, when supported on all four sides, the work platform system 120 is capable of supporting a uniform load of 100 PSF at a 4:1 safety factor.

Another load test was conducted on the invention. In this second load test, a nominal 8 foot×8 foot module of a work platform system 120 was erected. The four hubs 10 of this module were supported off the floor and secured to resist uplift. Then, two additional 8 foot×8 foot work platform system 120 modules, or "grids", were assembled from one side of the original, supported module. This resulted in a 16 foot cantilever, which simulates a scenario that might be encountered during erection of the work platform system 120. The work platform system 120 included standard hubs 10, joists 30, supports 52, and the like, as discussed above. One extreme corner of the cantilever was loaded with weight to simulate a load on a cantilever. A 1,000 weight with a 30"×30" footprint was placed on the cantilevered corner. Additional 50 pound weights were added, producing a total live load on the corner of 2,200 pounds. The test was witnessed and there was no failure of the work platform system 120 and the maximum deflection at the hub 10 at the loaded corner was 6.5 inches. In conclusion, in a 16 foot cantilever configuration, the present invention is capable of supporting a load of 550 pounds with a 4:1 safety factor.

Figure 29:
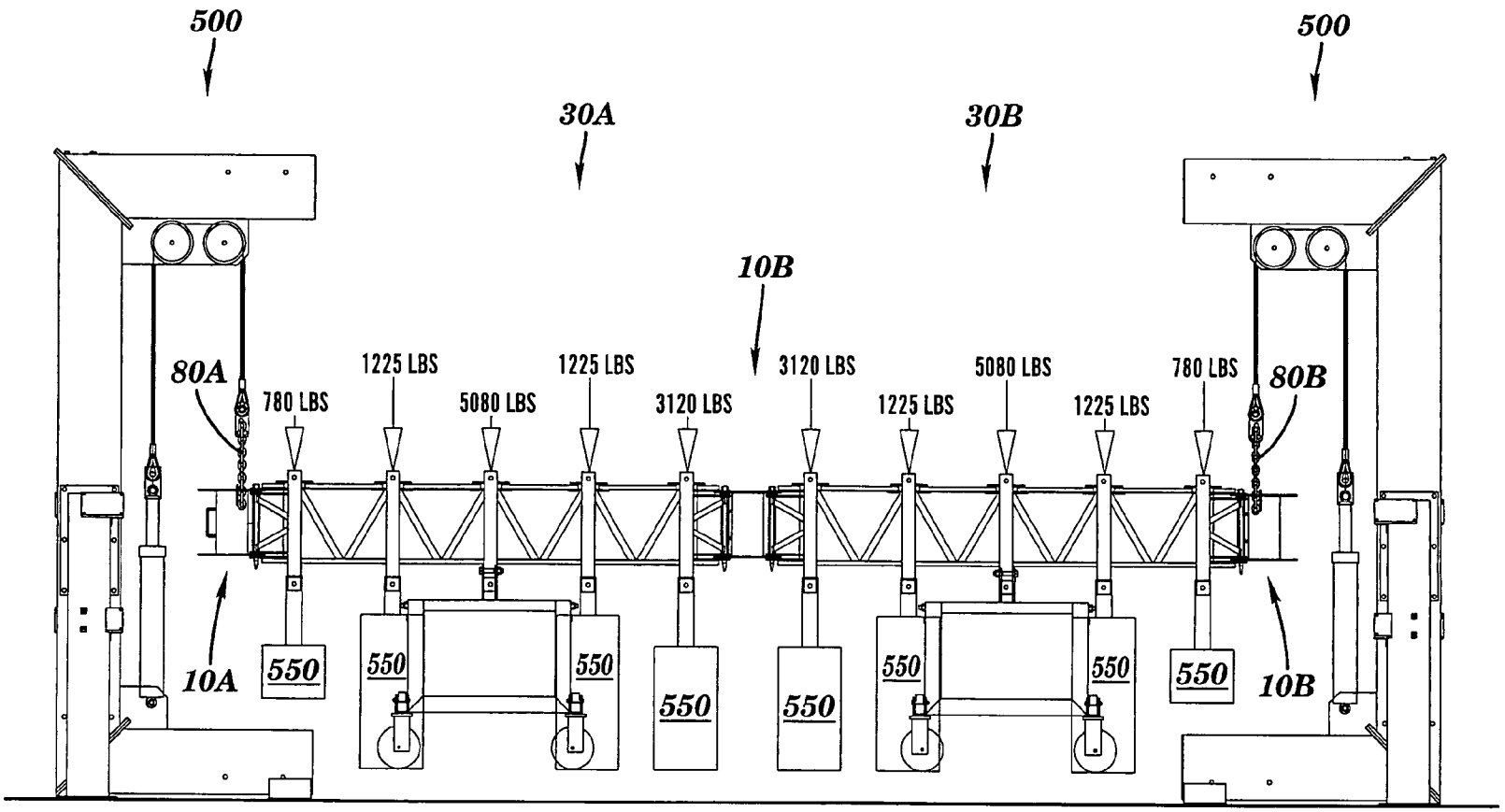
FIG. 29 is an elevation view of load test set up conducted on an embodiment of the present invention.

A third load test that was conducted, and witnessed, on an embodiment of the present invention, entailed the live loading of a 16 foot span with 45 PSF×4 Safety Factor (i.e., 180 PSF). In this test, as depicted in FIG. 29, two joists 30A, 30B and three hubs 10A, 10B, 10C were connected to form a 16 foot span. The span was then lifted via chains 80A, 80B connected to the two outer hubs 10A, 10C. The chains 80A, 80B were connected, in turn, to cables, hydraulic cylinders, and fixed framing 500. As FIG. 29 indicates weight (i.e., 22,835 pounds), simulating an intended live load plus a factor of safety of four, were suspended along lengths of the joists 30A, 30B. Strips of plywood approximately 1 foot wide were clamped to either side of the joists 30A, 30B in to simulate a portion of the platform 50. The structure (i.e., hubs 10, joists 30) was suspended with the aforementioned weight without failure. The test was repeated a second time, resulting in no failure.

A fourth load test conducted, and witnessed, on a portion of the present invention entailed a chain load test. In this test, a chain 80 was attached to a hub 10. The chain 80, which was a Grade 100 chain, was connected to one of the slots 17 of the hub 10, similar to the methods discussed above. The chain 80 and hub 10 assembly then was setup on a hydraulic test stand wherein a 30.6 Kip load was applied to the chain 80. There was no failure of either the hub 10 or chain 80. In conclusion, a typical hub 10 and chain 80 can withstand at least a 7.4 Kip load with a 4:1 factor of safety.

Thus, depending on spacing of the suspension connectors 80 that attach to the work platform system 120, various loading capabilities are created with the present invention. If the suspension connectors 80 are spaced in a 8 foot×8 foot grid configuration, the system 120 can be termed a heavy duty support system that can support 75 PSF. If the suspension connectors 80 are spaced at a 8 foot×16 foot grid, the system 120 can be termed a medium duty support system that can support 50 PSF. Similarly, if the suspension connectors 80 are spaced at 16 foot×16 foot grid, the system 120 can be termed a light duty support system that can support 25 PSF.

The foregoing description of the present invention has been presented for purposes of illustration and description. It is not intended to be exhaustive or to limit the invention to the precise form disclosed or to the materials in which the form may be embodied, and many modifications and variations are possible in light of the above teaching.

What is claimed is:

1. A work platform support system comprising:

a plurality of joists; and a plurality of hubs;

wherein the plurality of joists comprises four joists and wherein the plurality of hubs comprises four hubs;

wherein the joists and hubs are configured to be interconnected so that: i) one of the joists and two of the hubs are to remain stationary; ii) two of the joists are rotatable; and iii) two of the hubs and one of the joists are translatable;

wherein the joists and hubs are to be interconnected so that the two rotatable joists, the two translatable hubs, and the one translatable joist can articulate from an initial position to a final position with respect to the stationary joist and the stationary hubs;

wherein the plurality of joists are substantially co-planar with respect to each other in the initial and the final position;

wherein at least one of the joists is to be connected with at least one of the hubs using a pin to provide free rotation of the at least one joist with respect to the at least one hub about the pin; and wherein the free rotation is restricted by at least one of: i) an additional pin that is to be located proximate a perimeter of the at least one hub; and ii) at least a portion of a work platform when the platform is positioned with respect to the hubs and the joists in the final position.

2. The system of claim 1, wherein said plurality of joists are bar joists.

3. The system of claim 1, wherein said plurality of joists are open-web joists.

4. The system of claim 1, wherein said plurality of joists are shaped-steel.

5. The system of claim 1, further comprising a suspension connector that is to be operatively attached to at least one of said plurality of hubs.

6. The system of claim 5, wherein said suspension connector is a chain.

7. The system of claim 1, wherein the hubs and the joists are interconnected.

8. The system of claim 1, wherein said plurality of hubs include a plurality of openings configured to receive said plurality of joists.

9. The system of claim 8, wherein said plurality of openings include at least one slot.

10. The system of claim 1, further comprising said work platform.

11. The system of claim 1, wherein at least one of the hubs comprises:

a first surface with a first set of openings;

a second surface substantially parallel to said first surface, said second surface having a second set of openings; and a structural element connected between said first surface and said second surface, wherein at least one of said first set and said second set of openings is adapted to provide an articulation of said device when interconnected with said at least one joist;

wherein each one of the openings in the first set of openings is co-axial with a respective one of the openings in the second set of openings.

12. The system of claim 11, wherein said first surface is substantially planar.

13. The system of claim 11, wherein said second surface is substantially planar.

14. The system of claim 11, wherein said structural element is a cylinder.

15. The system of claim 11, wherein said structural element is a right circular cylinder.

16. The system of claim 15, wherein a longitudinal axis of said right circular cylinder is normal to said first surface and said second surface.

17. The system of claim 11, wherein said first surface and said second surface are configured to be interconnected with said at least one joist.

18. The system of claim 11, wherein one of said first surface and said second surface includes a support opening, wherein said support opening is configured to receive an attachment means.

19. The system of claim 18, wherein said attachment means is a chain.

20. The system of claim 18, wherein said support opening includes a slot.

21. The system of claim 1, wherein, when interconnected, each of the plurality of joists extends substantially perpendicularly with respect to an axis of at least one of the respective plurality of hubs about which the respective joists rotate.

22. A work platform support system comprising:

at least four hubs; and at least four joists, each of the four joists are configured to be interconnected with at least two of the four hubs;

wherein the joists and the hubs are configured to be interconnected so that: i) one of the joists—and two of the hubs—are configured to remain stationary; ii) two of the joists—are rotatable; and iii) two of the hubs—and one of the joists—are translatable;

wherein, when interconnected, the two rotatable joists, the two translatable hubs, and the one translatable joist can articulate from an initial position to a final position with respect to the stationary joist and the stationary hubs;

wherein the at least four joists—are substantially co-planar with respect to each other in the initial and the final positions;

wherein at least one of the joists is configured to be connected with at least one of the hubs using a pin to provide free rotation of the at least one joist with respect to the at least one hub about the pin; and wherein the free rotation is restricted by at least one of: i) an additional pin that is to be located proximate a perimeter of the at least one hub; and ii) at least a portion of a work platform when the platform is positioned with respect to the hubs and the joists in the final position.

23. A work platform support system for suspending a work platform from a structure, said system comprising:

a plurality of joists;

at least one of a plurality of hubs for interconnecting at least two of said plurality of joists; and a suspension connector for suspending at least one of the plurality of joists and at least one of the plurality of hubs from a structure;

wherein the plurality of joists comprises four joists and wherein the plurality of hubs comprises four hubs;

wherein the joists and hubs are configured to be interconnected so that: i) one of the joists and two of the hubs are to remain stationary; ii) two of the joists are rotatable; and iii) two of the hubs and one of the joists are translatable;

wherein, when interconnected, the two rotatable joists, the two translatable hubs, and the one translatable joist can articulate from an initial position to a final position with respect to the stationary joist and the stationary hubs;

wherein the plurality of joists are substantially coplanar with respect to each other in the initial and the final positions; and wherein at least one of the joists is configured to be connected with at least one of the hubs using a pin to provide free rotation of the at least one joist with respect to the at least one hub about the pin; and wherein the free rotation is restricted by at least one of: i) an additional pin that is to be located proximate a perimeter of the at least one hub; and ii) at least a portion of a work platform when the platform is positioned with respect to the hubs and the joists in the final position.

24. A work platform support structure comprising:

a first hub connectable in fixed relation to a second hub using a first joist; and a third hub connectable to a fourth hub using a second joist, the third and the fourth hubs further connectable to the first and the second hubs using third and fourth joists;

wherein, when connected, the second, the third and the fourth joists, and the third and the fourth hubs articulate from an initial position to an extended position with respect to the first and second hubs and the first joist;

wherein, when connected, each of the first, second, third and the fourth joists extends substantially perpendicularly with respect to an axis of at least one of the respective first, second, third and fourth hubs about which the respective joists rotate;

wherein the first, second, third and the fourth joists are substantially co-planar with respect to each other in the initial and the extended positions;

wherein at least one of the joists is to be connected with at least one of the hubs using a pin to provide free rotation of the at least one joist with respect to the at least one hub about the pin; and wherein the free rotation is restricted by at least one of: i) an additional pin that is configured to be located proximate a perimeter of the at least one hub; and ii) at least a portion of a work platform when the platform is positioned with respect to the hubs and the joists in the extended position.

25. The work platform support structure of claim 24 wherein at least one of the second, the third and the fourth joists rotates with respect to at least one of the first hub and the second hub.

26. The work platform support structure of claim 24 wherein, when connected, at least one of the second, the third and the fourth joists translates with respect to at least one of the first joist, the first hub and the second hub.

27. The work platform support structure of claim 24 wherein, when connected, at least one of the second, the third and the fourth joists pivots with respect to at least one of the third hub and the fourth hub.

28. The work platform support structure of claim 24, wherein each of the first, second, third and the fourth hubs comprises:

a first surface with a first set of openings;

a second surface substantially parallel to said first surface, said second surface having a second set of openings; and a structural element connected between said first surface and said second surface;

wherein each one of the openings in the first set of openings is co-axial with a respective one of the openings in the second set of openings.

29. A work platform support structure comprising:

a first pair of hubs connectable in fixed relation to each other using a first joist; and a second pair of hubs connectable to each other using a second joist, the second pair of hubs further connectable to the first pair of hubs using third and fourth joists;

wherein, when connected, the second, the third and the fourth joists and the second pair of hubs articulate from an initial position to a final position with respect to the first pair of hubs and the first joist;

wherein, when connected, each of the first, second, third and the fourth joists extends substantially perpendicularly with respect to an axis of at least one of the respective hubs in the first and the second pair of hubs about which the respective joists rotate; and wherein the first, second, third and the fourth joists are substantially co-planar with respect to each other in the initial and the final positions;

wherein at least one of the joists is configured to be connected with at least one of the hubs using a pin to provide free rotation of the at least one joist with respect to the at least one hub about the pin; and wherein the free rotation is restricted by at least one of: i) an additional pin that is to be located proximate a perimeter of the at least one hub; and ii) at least a portion of a work platform when the platform is positioned with respect to the hubs and the joists in the final position.

30. The work platform support structure of claim 29 wherein, when connected, the second joist, the third joist or the fourth joist rotates with respect to the first hub or the second hub.

31. The work platform support structure of claim 30 wherein, when connected, the second joist, the third joist or the fourth joist translates with respect to the first joist, the first hub or the second hub.

32. The work platform support structure of claim 31 wherein, when connected, the second joist, the third joist or the fourth joist pivots with respect to the third hub or the fourth hub.

33. A work platform structure comprising:

a first hub and joist assembly comprising pair of hubs connectable in fixed relation to each other using a first joist;

a second hub and joist assembly comprising a pair of hubs connectable to each other using a second joist, the pair of hubs further connectable to third and fourth joists;

wherein, when connected, the second hub and joist assembly articulates with respect to the first hub and joist assembly;

wherein, when connected, each of the joists in the first and the second hub and joist assemblies extends substantially perpendicularly with respect to an axis of at least one of the respective first, second, third and fourth hubs about which the respective joists rotate;

wherein, when connected, each of the joists in the first and the second hub and joist assemblies is substantially co-planar with respect to each other in an initial position and an extended position; and wherein at least one of the joists is configured to be connected with at least one of the hubs using a pin to provide free rotation of the at least one joist with respect to the at least one hub about the pin; and wherein the free rotation is restricted by at least one of: i) an additional pin that is to be located proximate a perimeter of the at least one hub; and ii) at least a portion of a work platform when the platform is positioned with respect to the hubs and the joists in the extended position.

34. The work platform support structure of claim 33 wherein, when connected, at least one of the second, the third and the fourth joists rotates with respect to at least one of the first hub and the second hub; wherein, when connected, at least one of the second, the third and the fourth joists translates with respect to at least one of the first joist, the first hub and the second hub; and wherein, when connected, at least one of the second, the third and the fourth joists pivots with respect to the third hub and the fourth hub.

35. A work platform support structure comprising:

a first joist having fixed first and second hubs connectable thereto;

a rotatable second joist connectable to either the first or the second hub, a rotatable third joist connectable to the other of the first or the second hub;

a third hub connectable to either the rotatable second joist or the rotatable third joist and a fourth hub connectable to the other of the second or the third joist; and a fourth joist connectable to the third and the fourth hubs;

wherein, when connected, the second, third and fourth joists and the third and fourth hubs together articulate with respect to the stationary first joist and fixed first and second hubs from an initial position to a final position in which a work platform can be received and supported;

wherein at least one of the joists is to be connected with at least one of the hubs using a pin to provide free rotation of the at least one joist with respect to the at least one hub about the pin;

wherein the free rotation is restricted by at least one of: i) an additional pin that is to be located proximate a perimeter of the at least one hub; and ii) at least a portion of a work platform when the platform is positioned with respect to the hubs and the joists in the final position;

wherein each of the first, second, third and the fourth hubs comprises a first surface with a first set of openings; a second surface substantially parallel to said first surface and having a second set of openings; and a structural element connected between the first surface and the second surface, such that each one of the openings in the first set of openings is co-axial with a respective one of the openings in the second set of openings; and wherein the first, second, third and the fourth joists are substantially co-planar with respect to each other in both the initial and the final positions.

36. The work platform support structure of claim 35 wherein, when connected, the second joist, the third joist or the fourth joist translates with respect to the first joist, the first hub or the second hub.

37. The work platform support structure of claim 36 wherein, when connected, the second joist, the third joist or the fourth joist pivots with respect to the third hub or the fourth hub.

38. The work platform support structure of claim 35, wherein, when connected, each of the first, second, third and the fourth joists extends substantially perpendicularly with respect to an axis of at least one of the respective first, second, third and the fourth hubs about which the respective joists rotate.

39. A work platform support structure comprising:

a first hub and joist assembly comprising a first joist and a pair of hubs connectable to the first joist; and a second hub and joist assembly comprising a rotatable second joist, a rotatable third joist and a translatable fourth joist, the second, third and fourth joists connectable together using a pair of hubs;

wherein at least two of the three joists of the second hub and joist assembly are connectable to the hubs of the first hub and joist assembly;

wherein, when connected, the second hub and joist assembly articulates with respect to the first hub and joist assembly in order to receive and support a work platform;

wherein each of the hubs in the first and the second hub and joist assemblies comprises a first surface with a first set of openings; a second surface substantially parallel to said first surface and having a second set of openings; and a structural element connected between the first surface and the second surface, such that each one of the openings in the first set of openings is co-axial with a respective one of the openings in the second set of openings;

wherein, when connected, each of the joists in the first and the second hub and joist assemblies is substantially co-planar with respect to each other in a first initial position and a second extended position;

wherein at least one of the joists is configured to be connected with at least one of the hubs using a pin to provide free rotation of the at least one joist with respect to the at least one hub about the pin; and wherein the free rotation is restricted by at least one of: i) an additional pin that is to be located proximate a perimeter of the at least one hub; and ii) at least a portion of a work platform when the platform is positioned with respect to the hubs and the joists in the extended position.

40. The work platform support structure of claim 39 wherein, when connected, the second joist, the third joist or the fourth joist pivots with respect to the third hub or the fourth hub.

41. A work platform assembly comprising:

first, second, third and fourth hubs, each of the hubs comprising a first surface with a first set of openings; a second surface substantially parallel to said first surface and having a second set of openings, such that each one of the openings in the first set of openings is co-axial with a respective one of the openings in the second set of openings; and a structural element connected between the first surface and the second surface such that a longitudinal axis of the structural element is at least substantially normal to the planes of the first and the second surfaces;

first, second, third and fourth joists adapted for operable association with the first, second, third and fourth hubs, such that, when so associated, each of the first, second, third and the fourth joists extends substantially perpendicularly with respect to an axis of at least one of the respective first, second, third and the fourth hubs about which the respective joists can rotate;

a work platform that is adapted to be positioned upon at least one of the first, second, third and the fourth joists, at least one of the first, second, third and the fourth hubs, or a combination thereof, when the hubs and joists are operably associated, to form a work platform system;

wherein, when operably associated, (i) the first hub is connected in fixed relation to the second hub using the first joist; (ii) the third hub is connected to the fourth hub using the second joist—and (iii) the third and the fourth joists are connected to the first and the third, and the second and the fourth hubs respectively;

wherein, when operably associated, at least one of the second, third and the fourth joists, and at least one of the third and the fourth hubs articulate from an initial position to a final position by at least one of translating, rotating and pivoting with respect to the first and the second hubs and the first joist to obtain a closed-loop structure such that the first and the third joists are parallel or substantially parallel to the second and the fourth joists respectively in the final position upon articulation;

wherein each of the first, second, third and fourth joists is substantially co-planar in the initial and the final positions;

wherein at least one of the joists is configured to be connected with at least one of the hubs using a pin to provide free rotation of the at least one joist with respect to the at least one hub about the pin; and wherein the free rotation is restricted by at least one of: i) an additional pin that is to be located proximate a perimeter of the at least one hub; and ii) at least a portion of a work platform when the platform is positioned with respect to the hubs and the joists in the final position.

42. The work platform assembly of claim 41, wherein the work platform system is capable of supporting at least four times an intended live load applied, or transmitted upon the work platform system in the final position.

43. The work platform assembly of claim 41, wherein the articulation of the second, third and the fourth joists, and the third and the fourth hubs is achieved in a cantilevered manner without requiring any hoisting equipment.

44. A work platform support structure comprising:

a first hub connectable in fixed relation to a second hub using a first joist;

a third hub connectable to a fourth hub using a second joist, the third and the fourth hubs further connectable to the first and the second hubs using third and fourth joists;

wherein, when connected, the second, the third and the fourth joists, and the third and the fourth hubs articulate with respect to the first and second hubs and the first joist to an extended or final position;

wherein at least one of the joists is connectable with at least one of the hubs using a pin to provide free rotation of the at least one joist with respect to the at least one hub about the pin; and wherein the free rotation is restricted by at least one of: i) an additional pin that is to be located proximate a perimeter of the at least one hub; and ii) at least a portion of a work platform when the platform is positioned with respect to the hubs and the joists in the extended or final position.

45. The work platform support structure of claim 44 wherein at least one of the hubs comprises:

a first surface with a first set of openings;

a second surface parallel or substantially parallel to said first surface, said second surface having a second set of openings; and a structural element connecting said first surface and said second surface;

wherein at least one of the openings of the first set of openings is co-axial with at least one of the openings in the second set of openings.

46. The work platform support structure of claim 45 wherein the at least one joist is connected to the at least one hub via the co-axial openings.

47. The work platform support structure of claim 44, further comprising said work platform.

48. The work platform support structure of claim 44, wherein the first, second, third and fourth hubs and joists, respectively, are connected.

* * * * *